US011292635B2

(12) United States Patent
Mundy et al.

(10) Patent No.: US 11,292,635 B2
(45) Date of Patent: Apr. 5, 2022

(54) PLATE ATTACHMENT ASSEMBLY

(71) Applicants: Christopher Wayne Mundy, Miramar, FL (US); Johny Ismar Delvar, Pompano Beach, FL (US)

(72) Inventors: Christopher Wayne Mundy, Miramar, FL (US); Johny Ismar Delvar, Pompano Beach, FL (US)

( * ) Notice: Subject to any disclaimer, the term of this patent is extended or adjusted under 35 U.S.C. 154(b) by 150 days.

(21) Appl. No.: 16/695,146

(22) Filed: Nov. 25, 2019

(65) Prior Publication Data

US 2020/0095019 A1 Mar. 26, 2020

Related U.S. Application Data

(63) Continuation-in-part of application No. 16/252,602, filed on Jan. 19, 2019, now Pat. No. 10,486,856.

(60) Provisional application No. 62/710,518, filed on Feb. 20, 2018.

(51) Int. Cl.

*B65D 21/032* (2006.01)
*B65D 21/02* (2006.01)
*B65D 43/02* (2006.01)

(52) U.S. Cl.

CPC ..... *B65D 21/0228* (2013.01); *B65D 43/0204* (2013.01); *B65D 2543/00027* (2013.01); *B65D 2543/00092* (2013.01); *B65D 2543/00351* (2013.01); *B65D 2543/00611* (2013.01); *B65D 2543/00694* (2013.01)

(58) Field of Classification Search

CPC ..... B65D 21/0228; B65D 2543/00027; B65D 41/065; B65D 2543/00351; B65D 2543/00611; B65D 2543/00694; B65D 2543/00092

USPC ..... 220/293, 295

See application file for complete search history.

(56) References Cited

U.S. PATENT DOCUMENTS

| | | | | |
|---|---|---|---|---|
| 2,999,611 | A | 9/1961 | Paulson | |
| 3,371,817 | A * | 3/1968 | Gasbarra | B65D 41/065 220/298 |
| 3,675,811 | A * | 7/1972 | Artz | B65D 43/0212 220/575 |
| 3,749,278 | A | 7/1973 | Boch-Galhau | |
| 4,206,845 | A | 6/1980 | Christian | |
| 4,333,580 | A * | 6/1982 | Sweigart, Jr. | E04H 1/1238 220/293 |
| 5,111,960 | A | 5/1992 | Zilliox | |
| 5,474,206 | A | 12/1995 | Herring, Sr. | |
| 5,676,273 | A * | 10/1997 | Jonkers | B65D 43/0225 220/293 |
| 5,894,953 | A | 4/1999 | Ramirez | |
| 6,338,417 | B1 | 1/2002 | Ferraro | |
| 6,474,494 | B1 | 11/2002 | Miller | |
| 6,923,338 | B2 | 8/2005 | Dees | |
| 7,097,063 | B2 | 8/2006 | Tucker et al. | |

(Continued)

*Primary Examiner* — Stephen J Castellano
(74) *Attorney, Agent, or Firm* — Mark C. Johnson; Johnson Dalal

(57) ABSTRACT

A plate attachment assembly that includes a first plate shell and a second plate shell configured to interlock with one another. The first plate shell and the second plate shell each have a bottom wall and a surrounding sidewall with a flange disposed thereon. The first and second plate shells are operably configured to selectively removably couple together in a watertight configuration using a locking tab disposed on one of the plate shells and a raised sidewall disposed above the flange of the first plate shell.

8 Claims, 20 Drawing Sheets

19-19

(56) References Cited

U.S. PATENT DOCUMENTS

| | | | |
|---|---|---|---|
| D593,364 | S | 6/2009 | Harris |
| 7,661,528 | B2 | 2/2010 | Vovan et al. |
| 8,118,190 | B2 | 2/2012 | Coonce |
| 8,993,022 | B1 | 3/2015 | Hertz |
| 9,101,237 | B2 | 8/2015 | Artsvelyan |
| 9,132,932 | B2 | 9/2015 | Scharfe et al. |
| 9,326,625 | B1 | 5/2016 | Esfahani |
| 2005/0189350 | A1 | 9/2005 | Hayes et al. |
| 2006/0218795 | A1 | 10/2006 | Cruz |
| 2007/0164019 | A1 | 7/2007 | Gartz |
| 2007/0198332 | A1 | 8/2007 | Beny |
| 2011/0163092 | A1 | 7/2011 | Hacsi |
| 2012/0234838 | A1 | 9/2012 | Cheng |

* cited by examiner

100

19-19

PLATE ATTACHMENT ASSEMBLY

CROSS-REFERENCE TO RELATED APPLICATION

This application is a continuation in part to U.S. Nonprovisional patent application Ser. No. 16/252,602 filed Jan. 19, 2019, now U.S. Pat. No. 10,486,856, which claimed priority to U.S. Provisional Patent Application No. 62/710,518 filed Feb. 20, 2018, the entirety of both are incorporated by reference.

FIELD OF THE INVENTION

The present invention relates generally to food containers, food serving devices, interlocking plate apparatuses, stackable containers, and the like. More particularly, the present invention relates to a plate attachment assembly which is designed to be interlocking, stackable, and attach to a drinking cup.

BACKGROUND OF THE INVENTION

Typically, a conventional food container is formed from a bottom shell, which can hold food, paired to a compatible closing lid. There are many different varieties of food containers and they are well known. Some food containers are made of different materials, such as plastic, glass, Styrofoam, etc. As such, some food containers are meant for temporary storage and immediate disposal and some containers are meant to be kept for longer periods of time or general appliance purposes. Further, food containers are used by a variety of different users. Some food containers are made for consumer purposes while others are made for commercial, restaurant service purposes.

Therefore, in general, food containers are used for a variety of reasons, which include to store food for later consumption or in order to transport food from one location to another. For example, on many occasions, people serve food in one location, e.g., a kitchen, and have to walk to another location where they are going to sit down and eat, e.g., a dining room table or an outdoor patio. For these reasons, development of food containers in which the top and bottom pieces interlock, preventing food from falling out or spilling if the container is dropped, have emerged. Additionally, users normally own more than one of these containers, and therefore, development of food containers in which the tops and bottoms, respectively, are designed to stack amongst one another to facilitate storage have also emerged. Finally, food containers which have the capability to, once the tops and bottoms are coupled to one another, stack atop one another and interlock into a singular structure, have emerged, allowing a user to carry multiple food containers at the same time for serving purposes. These efforts, however, have failed to address the need for food containers which are capable of stacking onto a drinking cup and creating a singular structure allowing the user to carry a drinking cup and a food container, or multiple stacked food containers, with a single hand.

Several known plate attachment assemblies are capable of attaching to a drinking cup. However, many of these assemblies consist of a plate which is capable of clipping onto a drinking cup by some fashion. Therefore, many of these assemblies do not incorporate a cover. Although some of the known plate attachment assemblies which are capable of attaching to a drinking cup incorporate a cover, none of these assemblies which incorporate a cover are capable of interlocking, such that the cover and the plate twist into a locked configuration forming a sealed and sturdy food container able to be securely stacked on top of a drinking cup. Moreover, the known plate attachment assemblies which incorporate a cover and are capable of attaching to a drinking cup are not capable of stacking more than one plate attachment assembly on top of another and onto the drinking cup to create a singular structure.

Other known plate attachment assemblies are capable of interlocking into a locked configuration with respect to the container portion and the cover. However, most of these assemblies are not able to be stacked atop one another in a secure position once the container portion and the cover are interlocked. Although there are some known plate attachment assemblies which are capable of interlocking and securely stacking atop one another once the container portion and the cover are interlocked, these assemblies are not capable of attaching to a drinking cup.

Some other known plate attachment assemblies which consist of a bottom shell and a lid are capable of twisting and interlocking, such as U.S. Pat. No. 9,326,625 (Esfahani). These assemblies also utilize a series of locking protrusions and apertures shaped and sized to restrain the locking protrusions once they are in a locked configuration. However, there are several drawbacks to these devices; for example, these devices do not allot for a method of securing the assembly to a drinking cup nor do they allow for the secure stacking of multiple assemblies atop one another or atop a drinking cup, thereby making these assemblies less efficient and narrower in their possible functionalities.

Therefore, a need exists to overcome the problems with the prior art as discussed above.

SUMMARY OF THE INVENTION

The invention provides a plate attachment assembly that overcomes the herein afore-mentioned disadvantages of the heretofore-known devices and methods of this general type and that effectively and efficiently interlocks, stacks multiple food containers and stacks on top of a drinking cup to allow a user to carry multiple items in one hand.

With the foregoing and other objects in view, there is provided, in accordance with the invention, a plate attachment assembly comprising a first plate shell having a bottom wall and a sidewall surrounding the bottom wall and having an upper end with a flange disposed around a perimeter thereon, the flange including a locking tab disposed thereon. The locking tab further including an upright locking portion with an upper end and an inner surface. The locking tab also includes a lateral locking portion coupled to and extending away from the upper end of the upright locking portion, wherein the upright locking portion has an inner surface and the inner surfaces of the upright and lateral locking portions of the locking tab define a secondary flange receiving channel. The locking tab further includes a locking protrusion coupled to and extending downwardly from the inner surface of the lateral locking portion of the locking tab with a distal free end terminating in the secondary flange receiving channel. The plate attachment assembly further comprises a second plate shell having a bottom wall and a sidewall surrounding the bottom wall and an upper end with a flange disposed around a perimeter thereon. The flange includes a lower surface, an upper surface, and defines a locking tab receiving aperture disposed thereon. The locking tab receiving aperture is shaped and sized to receive the lateral locking portion of the locking tab and a portion of the upright locking portion. The first plate shell and second plate shell are operably configured to selectively removably couple together, though the locking protrusion of the locking tab, in a locking configuration.

In accordance with another feature, the distal free end of the locking protrusion is rounded.

In accordance with a further feature, the lower surface of the flange of the second plate further comprises a notch defined thereon and of a shape corresponding to the rounded distal free end of the locking protrusion.

In accordance with a further feature, the flange of the second plate further comprises a ramp disposed proximal to the locking tab receiving aperture and ascending toward the lower surface of the flange of the second plate, toward the notch defined on the lower surface of the flange of the second plate.

In accordance with another feature, the flange of the second plate further comprises a locking tab receiving channel disposed adjacent to the ramp, disposed adjacent to the notch, and spatially coupled to the locking tab receiving aperture.

In accordance with another feature, the locking tab receiving channel is shaped and sized to receive the upright locking portion of the locking tab.

In some embodiments, the secondary flange receiving channel of the locking tab further comprises a receiving channel length separating the inner surface of the lateral locking portion of the locking tab and a lower end of the upright locking portion of the locking tab. The lower end of the upright locking portion of the locking tab opposes the upper end of the upright locking portion of the locking tab and the receiving channel length is greater than a first flange thickness separating the lower surface and the upper surface of the flange of the second plate shell.

In some embodiments, the plate attachment assembly further comprises a second locking tab disposed on the flange of the first plate shell. The second locking tab includes an upright locking portion with an upper end and an inner surface. The second locking tab further includes a lateral locking portion coupled to and extending away from the upper end of the upright locking portion of the second locking tab and with an inner surface. The inner surfaces of the upright and lateral locking portions of the second locking tab define a second secondary flange receiving channel. The second locking tab further includes a locking protrusion coupled to and extending downwardly from the inner surface of the lateral locking portion of the second locking tab. The locking protrusion has a distal free end terminating in the second secondary flange receiving channel. The plate attachment assembly further includes a second locking tab receiving aperture disposed on the flange of the second plate shell. The second locking tab receiving aperture is shaped and sized to receive the lateral locking portions of the locking tab and a portion of the upright locking portions of both the locking tab and the second locking tab. Moreover, the locking tab and the second locking tab are disposed on opposing sides of the first plate shell and the locking tab receiving aperture and the second locking tab receiving aperture are disposed on opposing sides of the second plate shell.

In accordance with another feature, the secondary flange receiving channel of the locking tab and the second secondary flange receiving channel of the second locking tab each further comprise a receiving channel length separating the inner surface of the lateral locking portion thereon and a lower end of the upright locking portion thereon. The lower end of the upright locking portion opposes the upper end of the upright locking portion and the receiving channel length is greater than a first flange thickness separating the lower surface and the upper surface of the flange of the second plate shell.

In some embodiments, the bottom surface of the bottom wall of the first plate shell further comprises a first cup support sidewall protruding therefrom, of a circular shape, and defining a circular area shaped and sized receive an upper end diameter of a drinking cup. The first cup support sidewall may be continuous (i.e., without gaps) or discontinuous (i.e., with gaps). Further, the first cup support sidewall is designed to resist lateral movement (i.e., side-to-side) of the upper end of a drinking cup by holding it in place.

In accordance with a further feature, the circular area of the cup support sidewall is within a range of approximately 2.5-3.5 inches.

In some embodiments, the bottom surface of the bottom wall of the first plate shell further comprises a second cup support sidewall protruding therefrom, of a circular shape, and defining a circular area shaped and sized to receive an upper end diameter of a larger-sized drinking cup. The circular area is within a range of approximately 3.5-4.25 inches. Moreover, the first cup support sidewall concentrically disposed in relation to the second cup support sidewall and has the circular area less than the circular area of the second cup support sidewall.

In some embodiments, the bottom surface of the bottom wall of the first and second plate shells further comprise a first plurality of plate support sidewalls protruding therefrom, defining a middle channel therein between, and of a circular shape. The bottom surface of the bottom wall of the first and second plate shells further comprise a second plurality of plate support sidewalls protruding therefrom, defining a middle channel therein between, of a circular shape, and opposing the first plurality of plate support sidewalls. The bottom surface of the bottom wall of the first and second plate shells further comprise a first plate locking member interposed between the first and second plurality of plate support sidewalls and with a uniform thickness less than the middle channels defined by the first and second plurality of plate support sidewalls. The bottom surface of the bottom wall of the first and second plate shells further comprise a second plate locking member interposed between the first and second plurality of plate support sidewalls, opposing the first plate locking member, and with a uniform thickness less than the middle channels defined by the first and second plurality of plate support sidewalls.

In some embodiments, the plate attachment assembly comprises a first plate shell having a bottom wall, with a bottom surface, and a sidewall surrounding the bottom wall and having an upper end with a flange disposed around a perimeter thereon. The flange includes a locking tab disposed thereon and the bottom surface of the bottom wall includes a first cup support sidewall protruding therefrom, of a circular shape, and defining a circular area shaped and sized receive an upper end diameter of a drinking cup. The plate attachment assembly further comprises a second plate shell having a bottom wall, with a bottom surface, and a sidewall surrounding the bottom wall and having an upper end with a flange disposed around a perimeter thereon. The flange includes a lower surface, an upper surface, and defines a locking tab receiving aperture disposed thereon. The locking tab receiving aperture is shaped and sized to receive the locking tab, wherein the first plate shell and second plate shell are operably configured to selectively removably couple together, though the locking tab, in a locking configuration.

In accordance with another feature, the bottom surface of the bottom wall of the first plate shell further comprises a second cup support sidewall protruding therefrom, of a circular shape, and defining a circular area shaped and sized receive an upper end diameter of a larger-sized drinking cup. The first cup support sidewall is concentrically disposed in relation to the second cup support sidewall, wherein the circular area is less than the circular area of the second cup support sidewall.

In some embodiments, the bottom surface of the bottom wall of the first and second plate shells further comprise a first plurality of plate support sidewalls protruding therefrom, defining a middle channel therein between, and of a circular shape. The bottom surface of the bottom wall of the first and second plate shells further comprise a second plurality of plate support sidewalls protruding therefrom, defining a middle channel therein between, of a circular shape, and opposing the first plurality of plate support sidewalls. The bottom surface of the bottom wall of the first and second plate shells further comprise a first plate locking member interposed between the first and second plurality of plate support sidewalls and with a uniform thickness less than the middle channels defined by the first and second plurality of plate support sidewalls. The bottom surface of the bottom wall of the first and second plate shells further comprise a second plate locking member interposed between the first and second plurality of plate support sidewalls, opposing the first plate locking member, and with a uniform thickness less than the middle channels defined by the first and second plurality of plate support sidewalls.

In accordance with another feature, the first plurality of plate support sidewalls each have opposing ends with a sidewall portion extending inwardly toward a center of the bottom wall and substantially orthogonal to a portion of the plurality of plate support sidewalls in which the sidewall portion extends from.

In some embodiments, the locking tab of the first plate shell includes an upright locking portion with an upper end and an inner surface. The locking tab of the first plate shell further includes a lateral locking portion coupled to and extending away from the upper end of the upright locking portion, with an inner surface, wherein the inner surfaces of the upright and lateral locking portions of the locking tab define a secondary flange receiving channel. The locking tab of the first plate shell further includes a locking protrusion coupled to and extending downwardly from the inner surface of the lateral locking portion of the locking tab, with a distal free end terminating in the secondary flange receiving channel. The flange of the second plate shell defines a locking tab receiving aperture disposed thereon that is shaped and sized to receive the lateral locking portion of the locking tab and a portion of the upright locking portion. The first plate shell and second plate shell are operably configured to selectively removably couple together, though the locking protrusion of the locking tab, in a locking configuration.

In accordance with yet another feature, the lower surface of the flange of the second plate further comprises a notch defined thereon and of a shape corresponding to a rounded distal free end of the locking protrusion.

One objective of the present invention is to provide a plate attachment assembly which functions as a food container shaped and sized to hold food items.

Another objective is to provide a plate attachment assembly able to be securely attached onto a drinking cup.

Another objective is to provide a plate attachment assembly which includes a lid that is able to securely lock into place and prevent food from spilling or falling if the assembly is accidentally dropped, for example.

Another objective of the present invention is to provide a plate attachment assembly which is able to securely stack on top of another identical plate attachment assembly and form a singular secure structure.

Another objective of the present invention is to provide a plate attachment assembly which is able to securely stack on top of one or more identical plate attachment assemblies as well as a drinking cup and form a singular secure structure.

Yet another objective is to provide a user with the option to stack and combine one or more plate attachment assemblies as well as a drinking cup into a singular secure structure, thereby providing a user with an easier method of simultaneously carrying multiple items and freeing the user's other hand.

Although the invention is illustrated and described herein as embodied in a plate attachment assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the first and second plate shells of the assembly.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
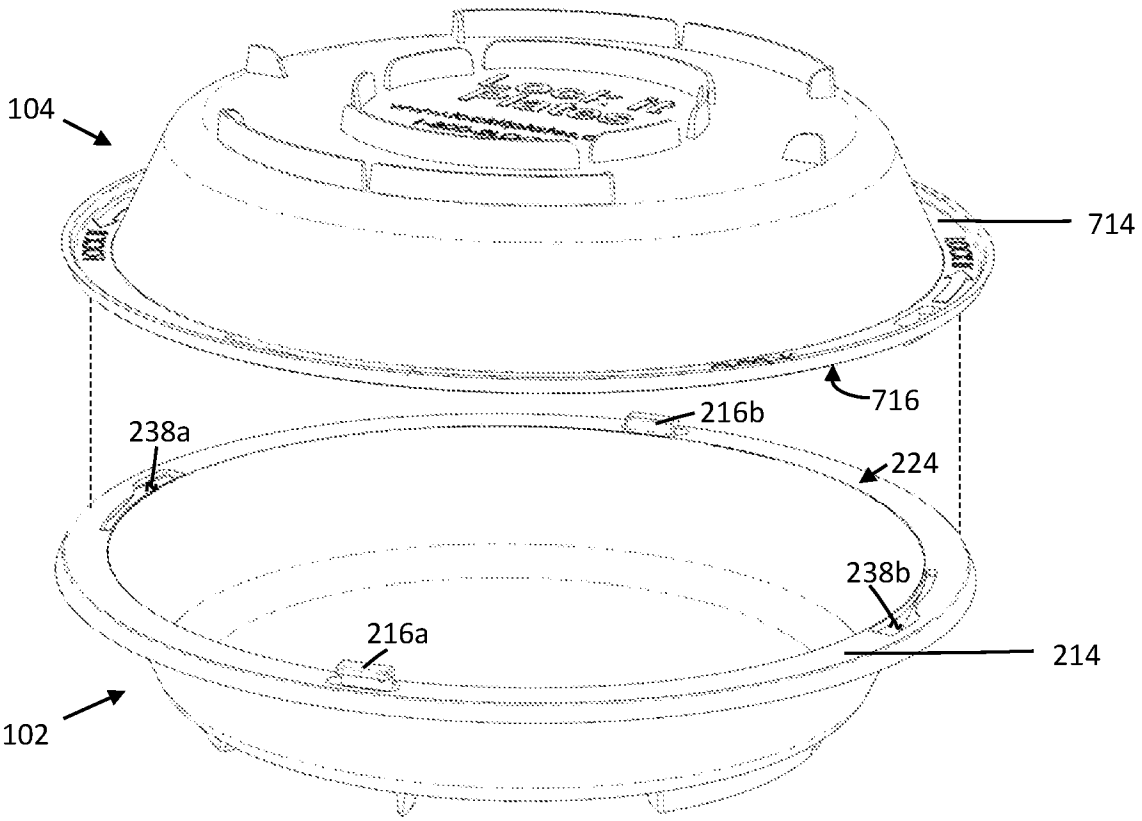
FIG. 1 is a perspective view of a plate attachment assembly according to one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

The present invention provides a novel and efficient plate attachment assembly that may be utilized, for example, as a food container, and which has the capability of stacking on top of another plate attachment assembly and/or a drinking cup. More specifically, embodiments of the invention provide a plate attachment assembly composed of a first plate shell having a bottom wall and a sidewall with a flange disposed around the perimeter that includes a locking tab. In addition, embodiments of the invention also provide a second plate shell having a bottom wall and a sidewall with a flange disposed around the perimeter that includes a locking tab receiving aperture. The first and second plate shells may combine with one another in a secure locking configuration.

Figure 2:
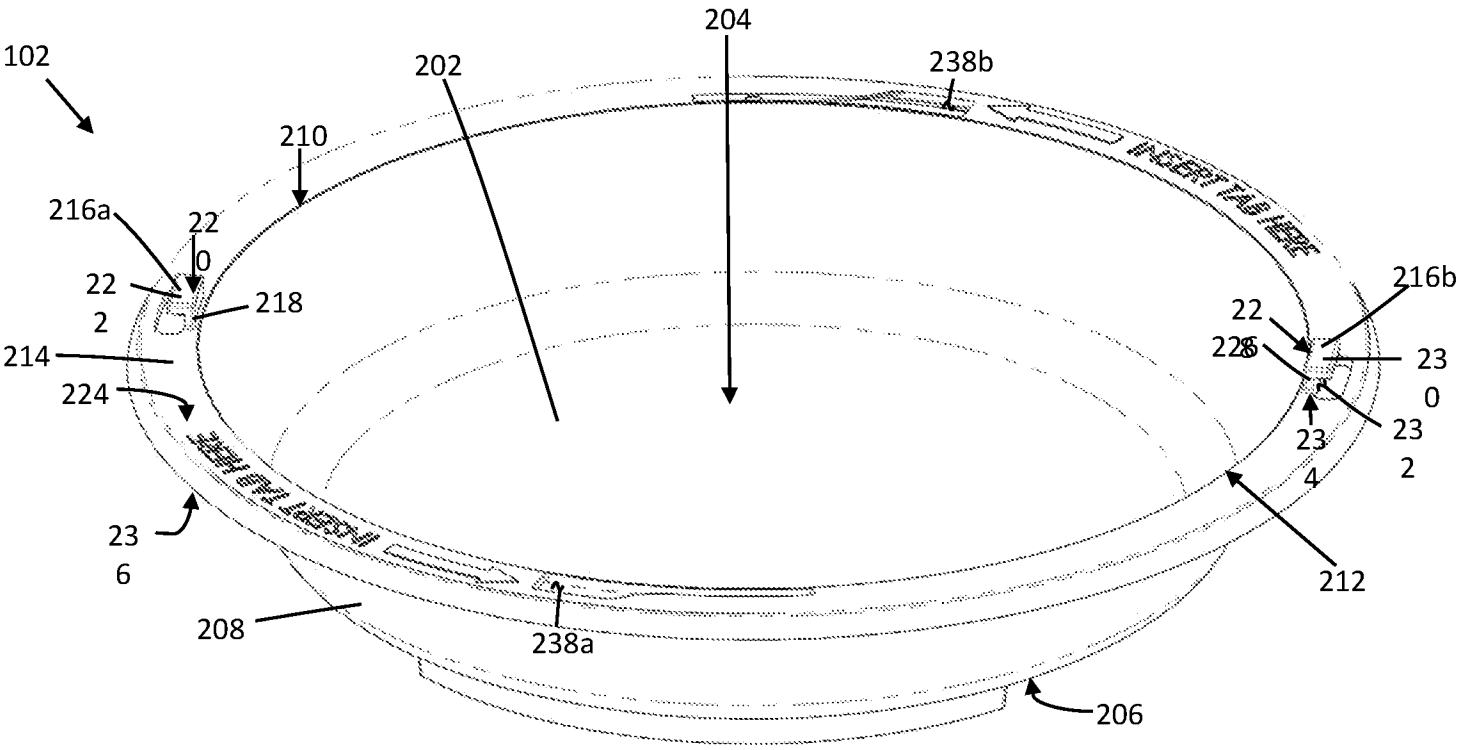
FIG. 2 is a perspective view of the first plate shell in FIG. 1 to be used in accordance with one embodiment of the present invention.
Figure 7:
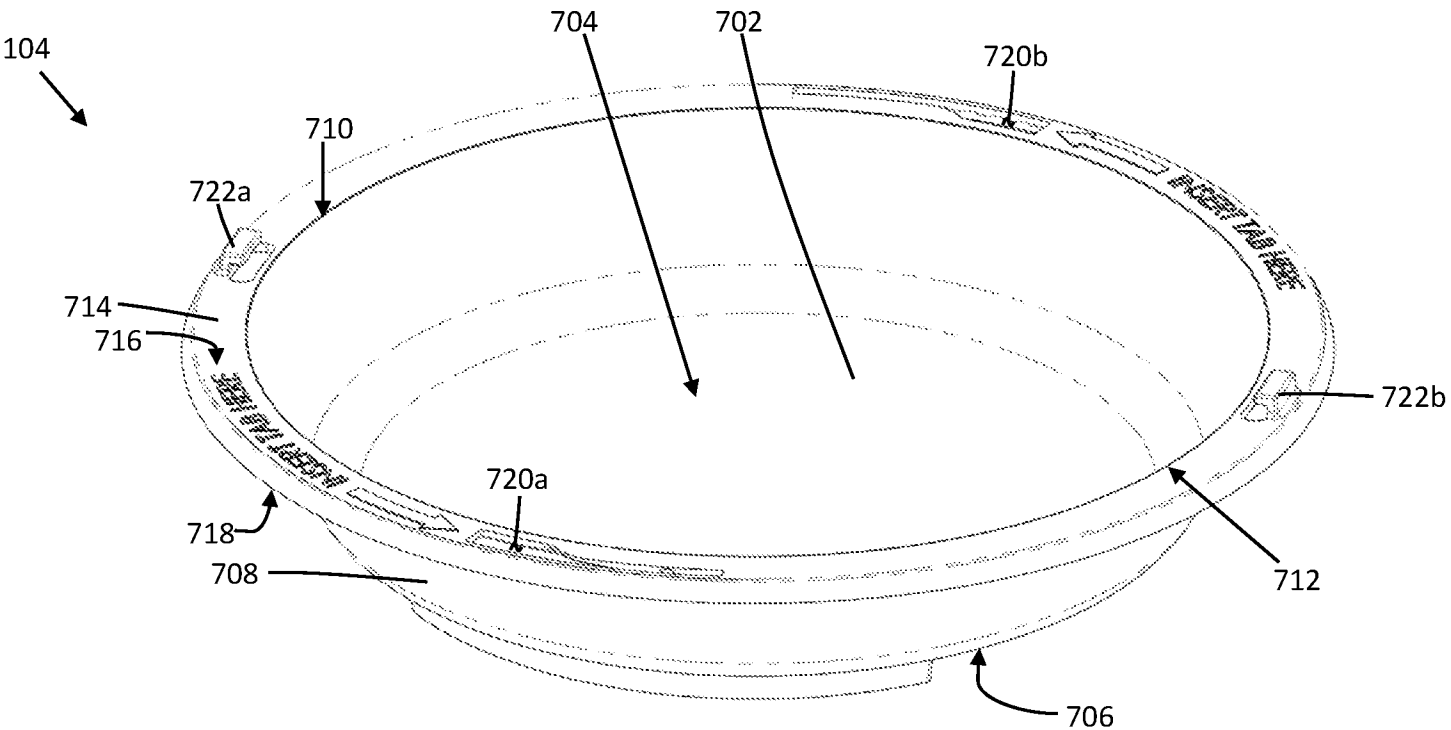
FIG. 7 is a perspective view of the second plate shell in FIG. 1 to be used in accordance with one embodiment of the present invention.

Referring now to FIGS. 1-2 and 7-8A, one embodiment of the present invention is shown in a perspective view. FIG. 1, along with other figures depicted herein, shows several advantageous features of the present invention, but, as will be described below, the invention can be provided in several shapes, sizes, combinations of features and components, and varying numbers and functions of the components. The first example of a plate attachment assembly 100, as shown in FIG. 1, includes a first plate shell 102 and a second plate shell 104. FIG. 1 depicts the first plate shell 102 detached from the second plate shell 104, but as will be revealed below, the first plate shell 102 may selectively removably couple to the second plate shell 104 in a locking configuration. Referring now to FIG. 2, the first plate shell 102 includes a bottom wall 202 having an interior surface 204 and a bottom surface 206 opposing the interior surface 204. The first plate shell 102 further includes a sidewall 208 surrounding the bottom wall 202. The sidewall 208 includes an upper end 210 having a perimeter 212. The sidewall 208 further includes a flange 214 disposed around the perimeter 212. The flange 214 includes an upper surface 224. Referring now to FIG. 7, the second plate shell 104 includes a bottom wall 702 having an interior surface 704 and a bottom surface 706 opposing the interior surface 704. The second plate shell 104 further includes a sidewall 708 surrounding the bottom wall 702. The sidewall 708 includes an upper end 710 having a perimeter 712. The sidewall 708 further includes a flange 714 disposed around the perimeter 712. The flange 714 includes an upper surface 716 and a lower surface 718 opposing the upper surface 716. The bottom walls 202, 702 and the sidewalls 208, 708 of the first and second plate shells 102, 104 are shaped and sized to receive food items (not shown).

In one embodiment, the interior surfaces 204, 704 of the bottom walls 202, 702 may be substantially planar. In other embodiments, the interior surfaces 204, 704 of the bottom walls 202, 702 may contain one or more divisional wall(s) (not shown) which are designed to separate a user's main course from his or her side dish(es) (not shown).

Figure 3:
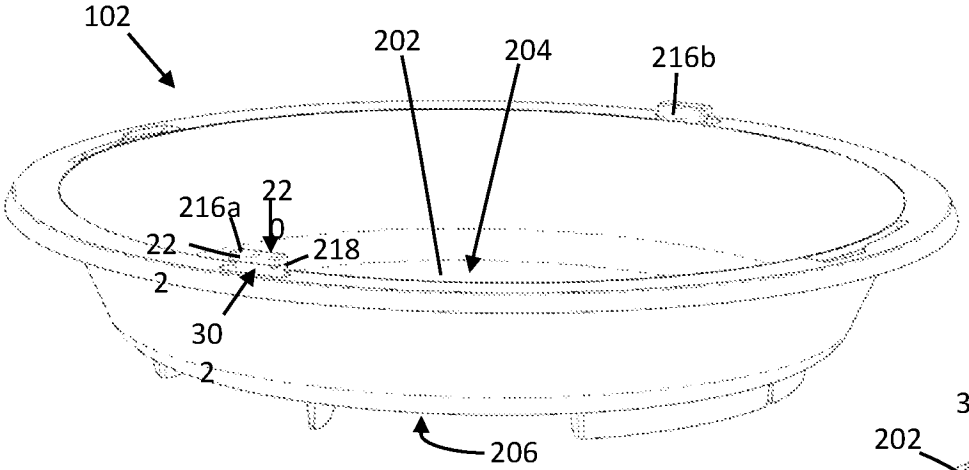
FIG. 3 is a perspective view of the first plate shell in FIG. 1 to be used in accordance with one embodiment of the present invention.
Figure 4:
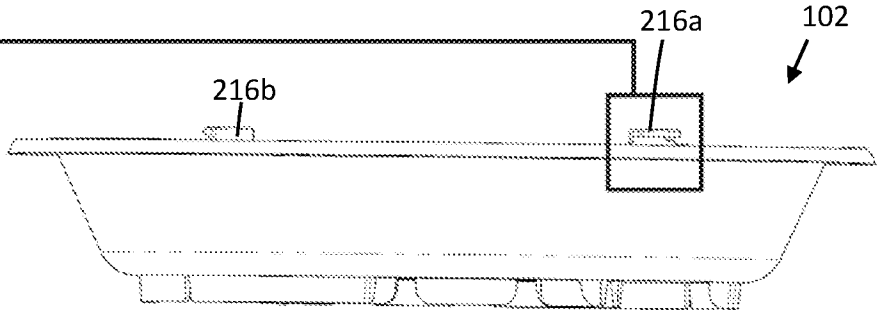
FIG. 4 is an elevational view of the first plate shell in FIG. 1 to be used in accordance with one embodiment of the present invention.
Figure 4A:
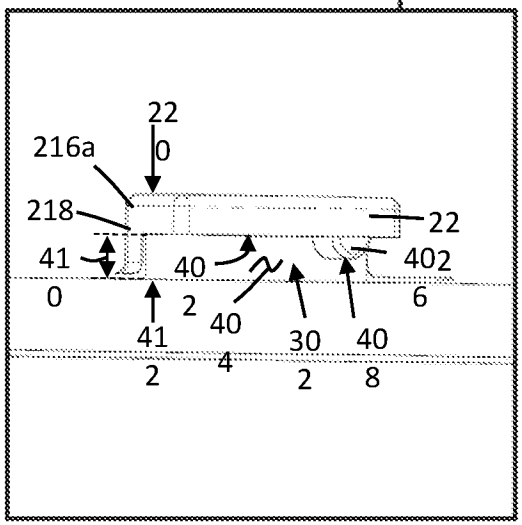
FIG. 4A is a fragmentary close-up view of a locking tab of the first plate shell in FIG. 1 in accordance with one embodiment of the present invention.

Referring back to FIG. 2, the first plate shell 102 further includes one or more locking tab(s) 216*a-b* disposed on the flange 214. In the preferred embodiment, there are two locking tabs 216*a*, 216*b* disposed on the flange 214. In other embodiments, there are three locking tabs (not shown) disposed on the flange 214. In yet other embodiments, there may be more or less locking tabs 216*a-b*. One, both or all of the locking tabs 216*a-b* may include the same main features, however, as a representative sample of the main features of locking tabs 216*a-b*, the main features of locking tab 216*a* will be described herein. The locking tab 216*a* includes an upright locking portion 218, wherein the upright locking portion 218 extends upwardly from the upper surface 224 of the flange 214. The upright locking portion 218 includes an upper end 220 and an inner surface 302 (shown in FIG. 3). The locking tab 216*a* further includes a lateral locking portion 222 coupled to and extending away from the upper end 220 of the upright locking portion 218. Referring now to FIG. 4A, the lateral locking portion 222 includes an inner surface 402. The inner surface 302 of the upright locking portion 218 and the inner surface 402 of the lateral locking portion 222 define a secondary flange receiving channel 404.

In a further embodiment, the locking tab 216*a* includes a locking protrusion 406 coupled to and extending downwardly from the inner surface 402 of the lateral locking portion 222. The locking protrusion 406 includes a distal free end 408 terminating in the secondary flange receiving channel 404. In one embodiment, the distal free end 408 of the locking protrusion 406 is rounded. In other embodiments, the distal free end 408 of the locking protrusion 406 may be of any shape.

As a representative sample of the placement of each locking tab 216*a-b* on the flange 214, the placement of locking tab 216*a* will be described herein. Referring to FIGS. 2-3, the upright locking portion 218 of the locking tab 216*a* is disposed proximal to the upper end 210 of the flange 214. Moreover, the lateral locking portion 222 extends away from the upper end 220, such that the inner surface 302 of the upright locking portion 218 is disposed in a direction facing opposite of the interior surface 204 of the bottom wall 202. In other embodiments, locking tab 216*a* can be placed wherein the upright portion 218 is instead disposed on an end opposing the upper end 210 of the flange 214, such that the lateral locking portion 222 extends towards the interior surface 204 of the bottom wall 202 and the inner surface 302 of the upright locking portion 218 is also disposed in a direction facing toward the interior surface 204 of the bottom wall 202.

It should be understood that terms such as, "front," "rear," "side," top," "bottom," and the like are indicated from the reference point of a viewer viewing the first plate shell 102 from the perspective shown in FIG. 2.

Referring back to FIG. 7, the lower surface 718 and the upper surface 716 of the flange 714 of the second plate shell 104 define one or more locking tab receiving aperture(s) 720*a-b* disposed thereon. In the preferred embodiment, there are two locking tab receiving apertures 720*a*, 720*b* disposed on the flange 714. In other embodiments, there are three locking tab receiving apertures (not shown). In yet other embodiments, there may be more or less locking tab receiving apertures 720*a-b*. However, in every embodiment, the amount of locking tabs 216*a-b* and locking tab receiving apertures 720*a-b* correspond with respect to one another. Said another way, there are an equal amount of locking tabs 216*a-b* on the first plate shell 102 as there are locking tab receiving apertures 720*a-b* on the second plate shell 104.

Figures 8, 8A:
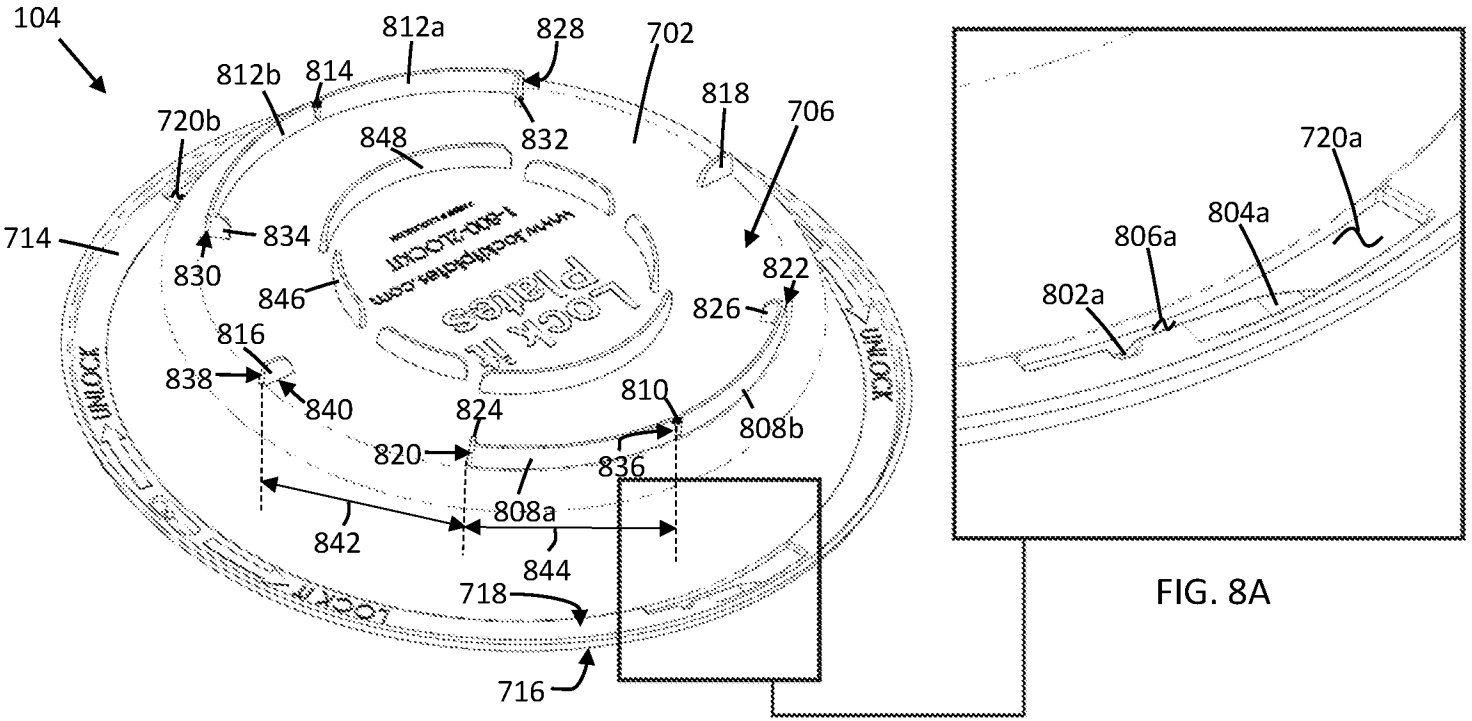
FIG. 8 is a perspective view of the second plate shell in FIG. 1 to be used in accordance with one embodiment of the present invention.
FIG. 8A is a fragmentary close-up view of a lower surface of a flange of the second plate shell in FIG. 1 in accordance with one embodiment of the present invention.
Figure 9:
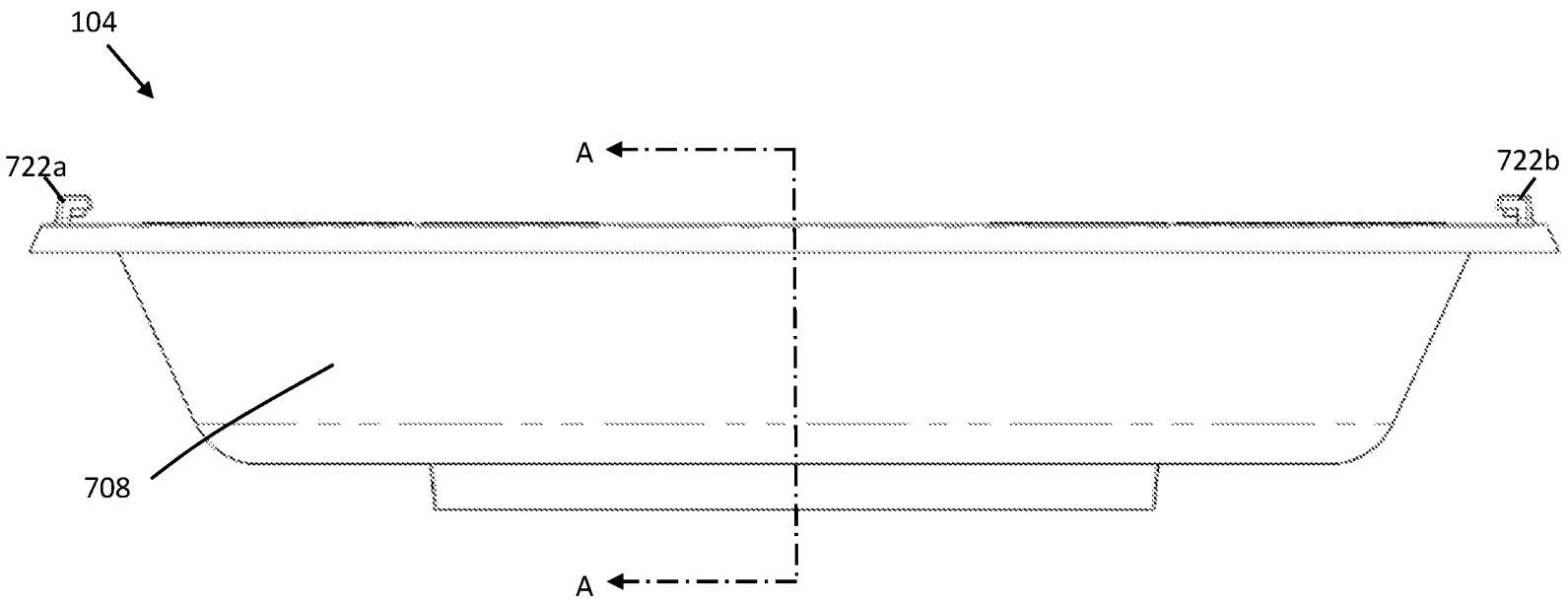
FIG. 9 is an elevational side view of the second plate shell in FIG. 1 to be used in accordance with one embodiment of the present invention.

In a further embodiment, best shown in FIGS. 8-8A, one, both or all of the locking tab receiving apertures 720*a-b* are shaped and sized to receive the lateral locking portion 222 of the locking tab 216*a* and a portion of the upright locking portion 218 of the first plate shell 102.

Figure 12:
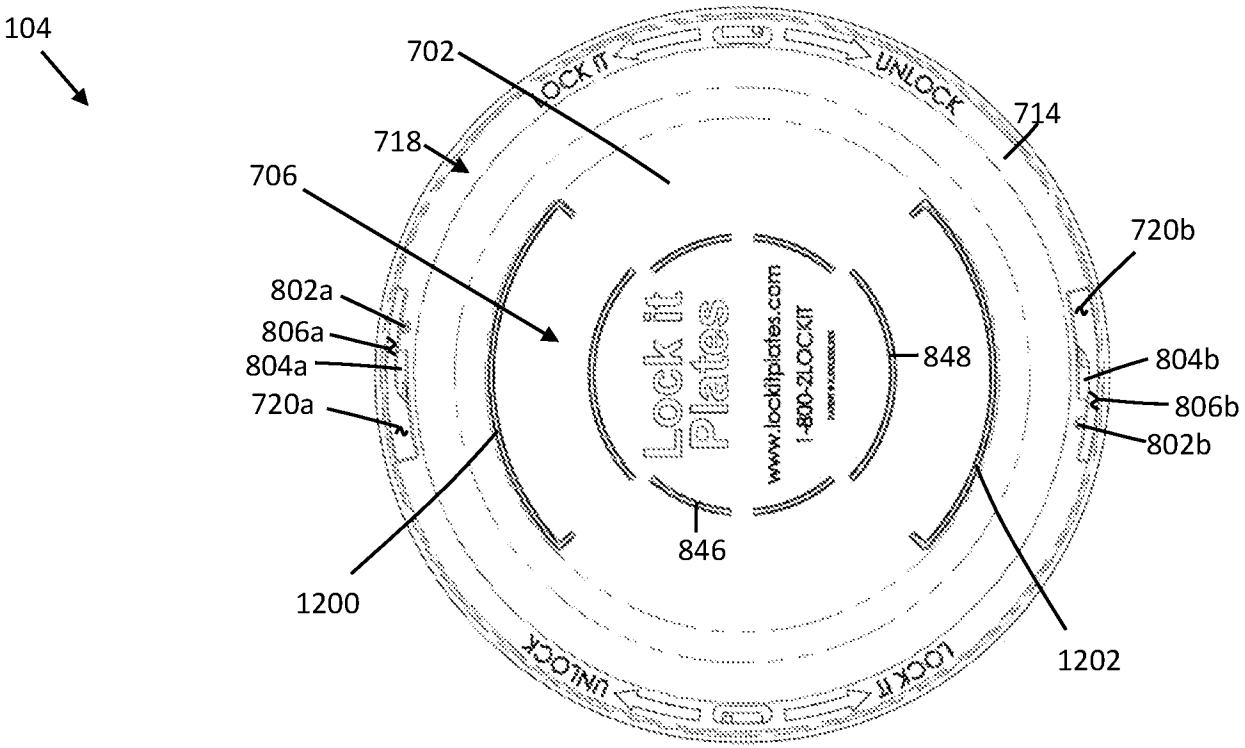
FIG. 12 is a bottom plan view of the second plate shell in FIG. 1 to be used in accordance with one embodiment of the present invention.

In a further embodiment, best seen in FIGS. 8A and 12, the lower surface 718 of the flange 714 of the second plate shell 104 further includes one or more notches 802*a-b* defined thereon and of a shape corresponding to the distal free end 408 (shown in FIG. 4A) of the locking protrusion 406 of the locking tab 216*a* of the first plate shell 102.

Figures 14, 14A:
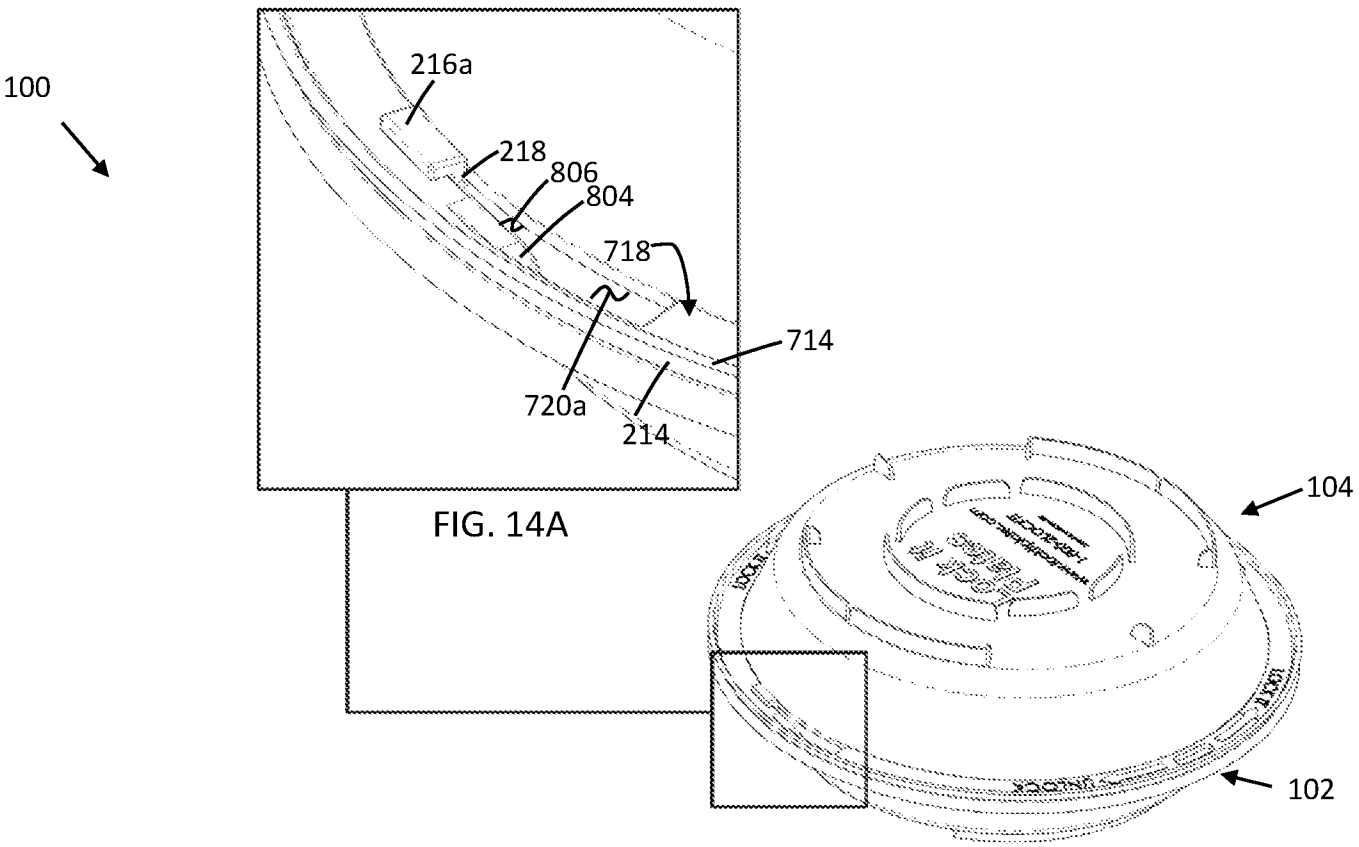
FIG. 14 is a perspective view of another exemplary embodiment of a plate attachment assembly in accordance with the present invention.
FIG. 14A is a fragmentary close-up view of another exemplary embodiment of a plate attachment assembly in accordance with the present invention.

In a further embodiment, best shown in FIGS. 14-14A, the first plate shell 102 and second plate shell 104 are operably configured to selectively removably couple together. As a representative sample of the method in which the first and second plate shells 102, 104 couple together, the locking configuration of the locking tab 216*a* on notch 802*a* will be described herein. The distal free end 408 (not shown) of the locking protrusion 406 (not shown) of the locking tab 216*a* of the first plate shell 102 and the notch 802*a* (not shown) of the lower surface 718 of the flange 714 of the second plate shell 104 are operably configured to selectively removably couple together and dispose the first and second plate shells 102, 104 in a locking configuration.

In a further embodiment, when the first plate shell 102 is selectively removably coupled to the second plate shell 104, food (not shown) may be placed on either the first or second plate shell 102, 104 and the food will be contained within an internal space (not shown) defined by the interior surfaces 204, 704 of the bottom walls 202, 702 and the sidewalls 208, 708 of the first and second plate shells 102, 104.

Referring back to FIGS. 8-8A and 12, the bottom surface 718 of the flange 714 of the second plate shell 104 further includes one or more ramps 804*a-b* disposed proximal to the locking tab receiving apertures 720*a-b*. The ramps 804*a-b* ascend toward the lower surface 718 of the flange 714 of the second plate shell 104 and toward the notches 802*a-b*.

In a further embodiment, the flange 714 of the second plate shell 104 further comprises one or more locking tab receiving channels 806*a-b* disposed adjacent to the ramps 804*a-b* and to the notches 802*a-b*. As a representative sample of the placement of the locking tab receiving channels 806*a-b*, the placement of locking tab receiving channel 806*a* will be described herein. The locking tab receiving channel 806*a* is spatially coupled to the locking tab receiving aperture 720*a*. Moreover, the locking tab receiving channel 806*a* is shaped and sized to receive the upright locking portion 218 of the locking tab 216*a* (shown best in FIG. 14A) of the first plate shell 102.

It should be understood that terms such as, "front," "rear," "side," top," "bottom," and the like are indicated from the reference point of a viewer viewing the second plate shell 104 from the perspective shown in FIG. 7.

Figures 10, 10A:
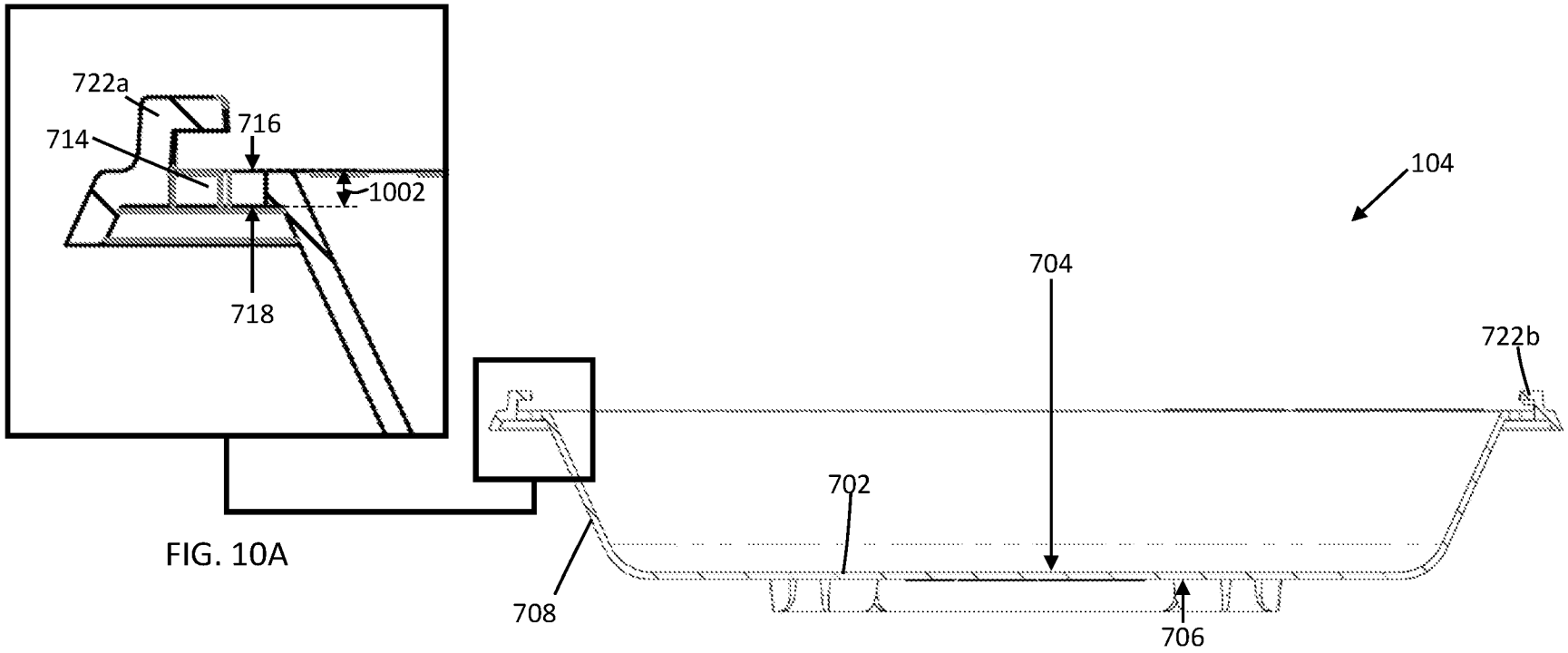
FIG. 10 is a cross-sectional view of the second plate shell in FIG. 1 taken along section line A-A of FIG. 9, in accordance with the present invention.
FIG. 10A is a fragmentary close-up cross-sectional view of a locking tab of the second plate shell in FIG. 1 taken along section line A-A of FIG. 9, in accordance with the present invention.
Figure 11:
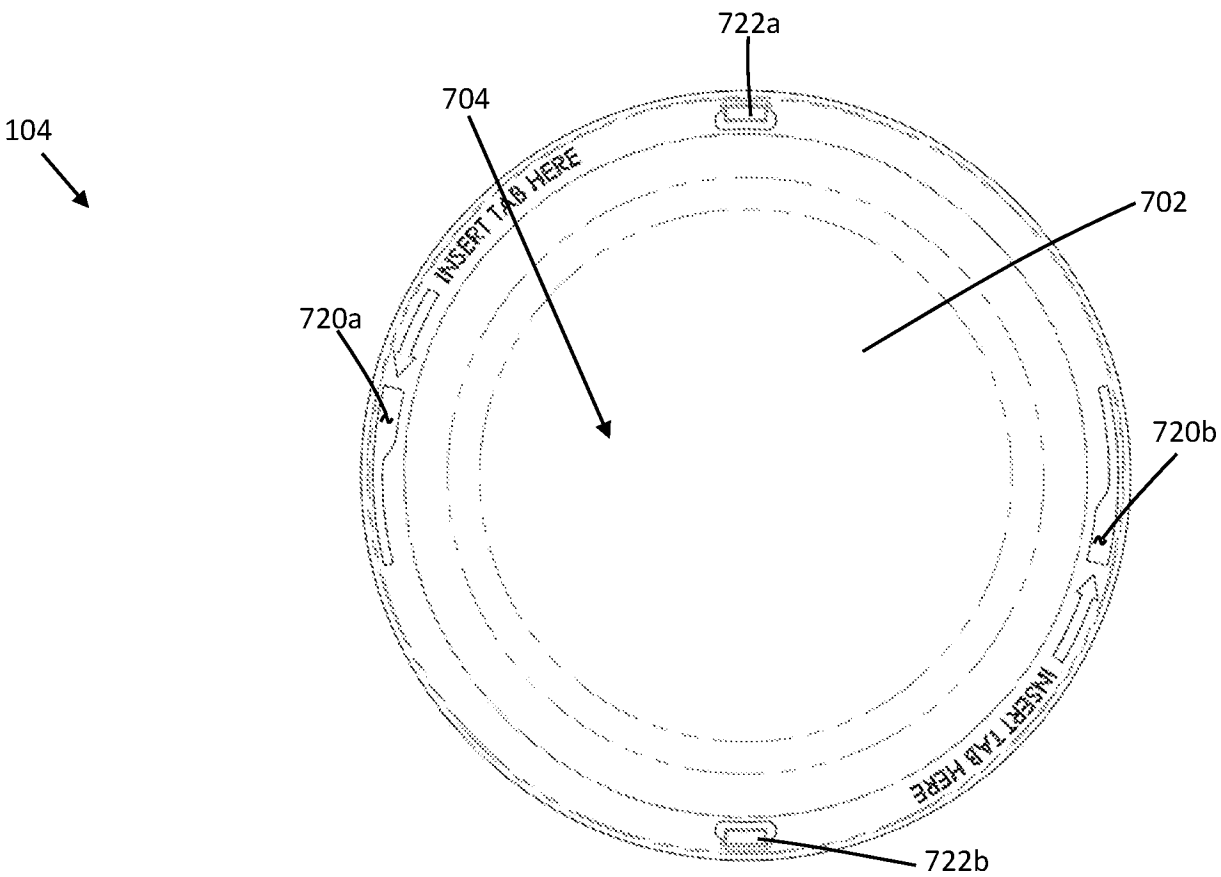
FIG. 11 is a top plan view of the second plate shell in FIG. 1 to be used in accordance with one embodiment of the present invention.

Referring back to FIG. 4-4A, the secondary flange receiving channel 404 of the locking tab 216*a* further comprises a receiving channel length 410 separating the inner surface 402 of the lateral locking portion 222 and a lower end 412 of the upright locking portion 218 of the locking tab 216*a*. The lower end 412 opposes the upper end 220 of the upright locking portion 218. Further, the receiving channel length 410 is greater than a first flange thickness 1002 (best shown in FIG. 10A) separating the lower surface 718 and the upper surface 716 of the flange 714 of the second plate shell 104.

Referring back to FIG. 2, in other embodiments wherein the first plate shell 102 of the plate attachment assembly 100 further comprises a second locking tab 216*b* disposed on the flange 214, the locking tab 216*a* and the second locking tab 216*b* are disposed on opposing sides of the first plate shell 102. The second locking tab 216*b* also features many of the same main components the locking tab 216*a* includes. The second locking tab 216*b* similarly includes an upright locking portion 226, wherein the upright locking portion 226 extends upwardly from the upper surface 224 of the flange 214. The upright locking portion 226 also includes an upper end 228 and an inner surface (not shown). The second locking tab 216*b* further includes a lateral locking portion 230 coupled to and extending away from the upper end 228 of the upright locking portion 226. The lateral locking portion 230 further includes an inner surface (not shown). The inner surface of the upright locking portion 226 and the inner surface of the lateral locking portion 230 define a second secondary flange receiving channel 232.

In a further embodiment, the second locking tab 216*b* similarly includes a locking protrusion (not shown) coupled to and extending downwardly from the inner surface of the lateral locking portion 230. The locking protrusion includes a distal free end (not shown) terminating in the second secondary flange receiving channel 232.

In a further embodiment, as shown in FIG. 7, the second plate shell 104 of the plate attachment assembly 100 further comprises a second locking tab receiving aperture 720*b* disposed on the flange 714. The locking tab receiving aperture 720*a* and the second locking tab receiving aperture 720*b* are disposed on opposing sides of the second plate shell 104. The second locking tab receiving aperture 720*b* also features many of the same main components that the locking tab receiving aperture 720*a* includes. The second locking tab receiving aperture 720*b* is similarly shaped and sized to receive the lateral locking portions 222, 230 of the locking tab 216*a* or the second locking tab 216*b* and a portion of the upright locking portions 218, 226 of either the locking tab 216*a* or the second locking tab 216*b* of the first plate shell 102.

In a further embodiment, referring back to FIG. 2, the second secondary flange receiving channel 232 of the second locking tab 216*b* of the first plate shell 102 also features many of the same main components that the secondary flange receiving channel 404 of the locking tab 216*a* includes. The second secondary flange receiving channel 232 similarly comprises a receiving channel length (not shown but equal to receiving channel length 410) separating the inner surface of the lateral locking portion 230 and a lower end 234 of the upright locking portion 228 of the locking tab 216*b*. The lower end 234 opposes the upper end 228 of the upright locking portion 226. Further, the receiving channel length is similarly greater than the first flange thickness 1002 (best shown in FIG. 10A) separating the lower surface 718 and the upper surface 716 of the flange 714 of the second plate shell 104.

Figure 3A:
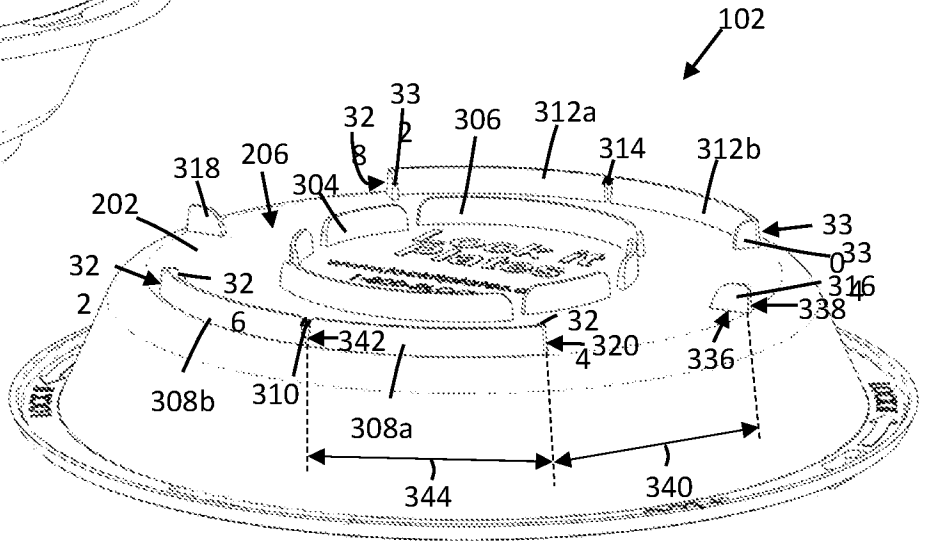
FIG. 3A is a perspective view of the first plate shell in FIG. 1 to be used in accordance with one embodiment of the present invention.
Figure 5:
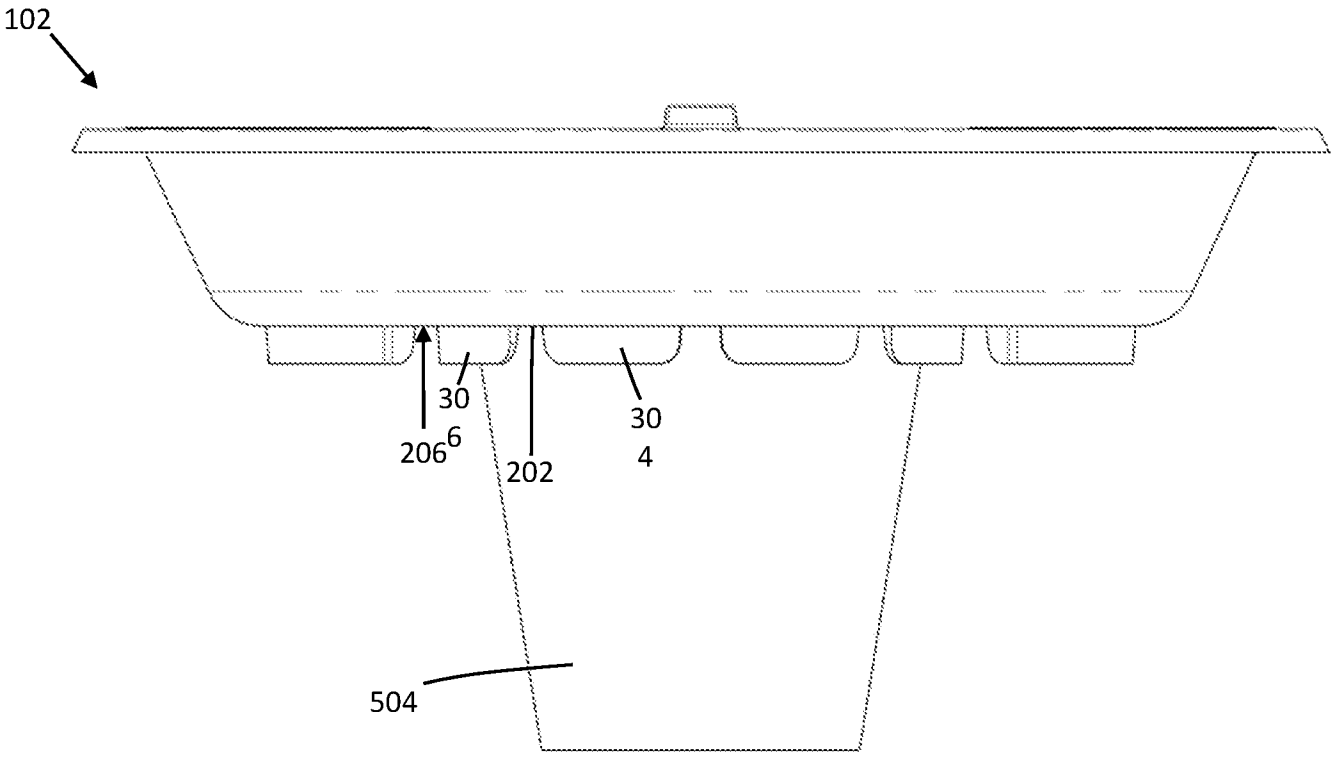
FIG. 5 is an elevational view of the first plate shell in FIG. 1 attached to a drinking cup in accordance with an exemplary embodiment of the present invention.
Figure 6:
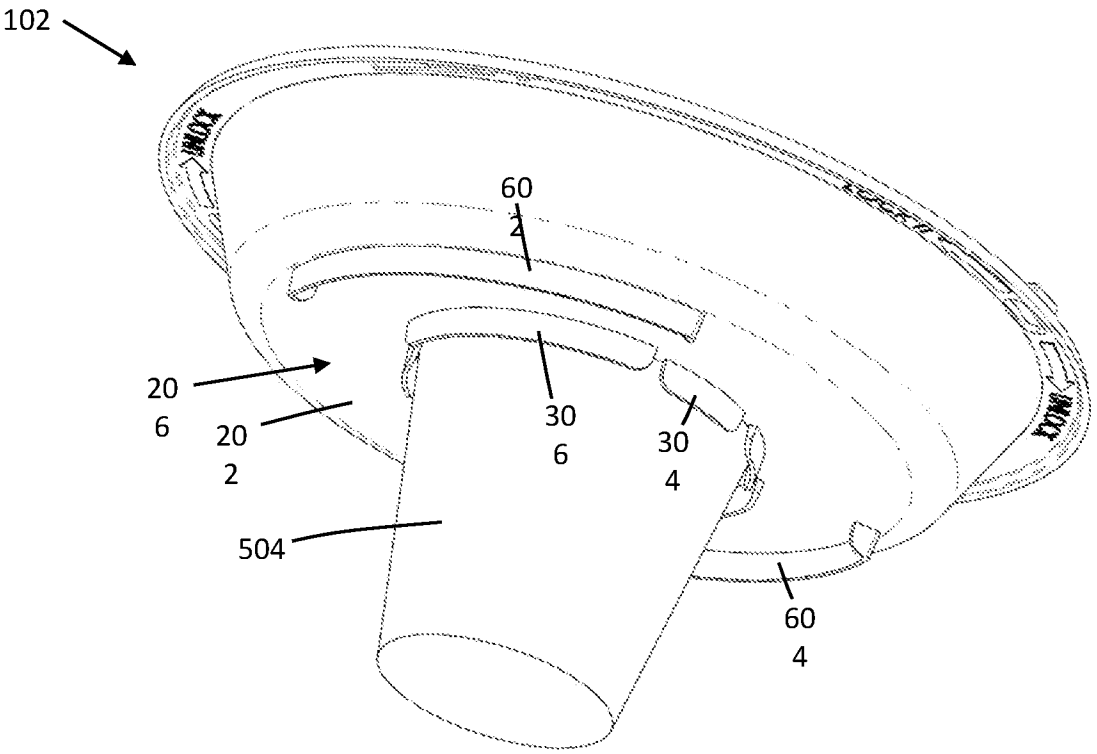
FIG. 6 is a perspective view of the first plate shell in FIG. 1 attached to a drinking cup in accordance with an exemplary embodiment of the present invention.

Referring now to FIG. 3A, in some embodiments, the bottom surface 206 of the bottom wall 202 of the first plate shell 102 further comprises a first cup support sidewall 304 protruding therefrom, of a circular shape, and defining a circular area shaped and sized to receive an upper end diameter (not shown) of a drinking cup 504 (shown in FIGS. 5-6). The first cup support sidewall 304 protrudes in a substantially perpendicular direction from the bottom surface 206 of the bottom wall 202. In some embodiments, the first cup support sidewall 304 may be continuous (i.e., without gaps), in other embodiments, the first cup support sidewall 304 may be discontinuous (i.e., with gaps). The embodiment of the first plate shell 102 shown in FIGS. 3A, 5-6 shows the first cup support sidewall 304 as discontinuous (with gaps). The first cup support sidewall 304 is designed to resist lateral movement (i.e., side-to-side) of the upper end of the drinking cup 504 by holding it in place. Further, the circular area of the first cup support sidewall 304 is within a range of approximately 2.5-3.5 inches to accommodate a majority of conventional cup diameters.

In a further embodiment, the bottom surface 206 of the bottom wall 202 of the first plate shell 102 further comprises a second cup support sidewall 306 protruding therefrom, of a circular shape, and defining a circular area (not shown) shaped and sized to receive an upper end diameter (not shown) of a larger-sized drinking cup (not shown). The second cup support sidewall 306 protrudes in a substantially perpendicular direction from the bottom surface 206 of the bottom wall 202. In some embodiments, the second cup support sidewall 306 may be continuous (i.e., without gaps), in other embodiments, the second cup support sidewall 306 may be discontinuous (i.e., with gaps). The embodiment of the first plate shell 102 shown in FIGS. 3A, 5-6 shows the second cup support sidewall 306 as discontinuous (with gaps). Similarly, the second cup support sidewall 306 is designed to resist lateral movement (i.e., side-to-side) of the upper end of the larger-sized drinking cup by holding it in place. Further, the circular area of the second cup support sidewall 306 is within a range of approximately 3.5-4.25 inches to accommodate a majority of larger-sized conventional cup diameters. The first cup support sidewall 304 is concentrically disposed in relation to the second cup support sidewall 306, wherein the circular area of the first cup support sidewall 304 is less than the circular area of the second cup support sidewall 306.

Figure 13:
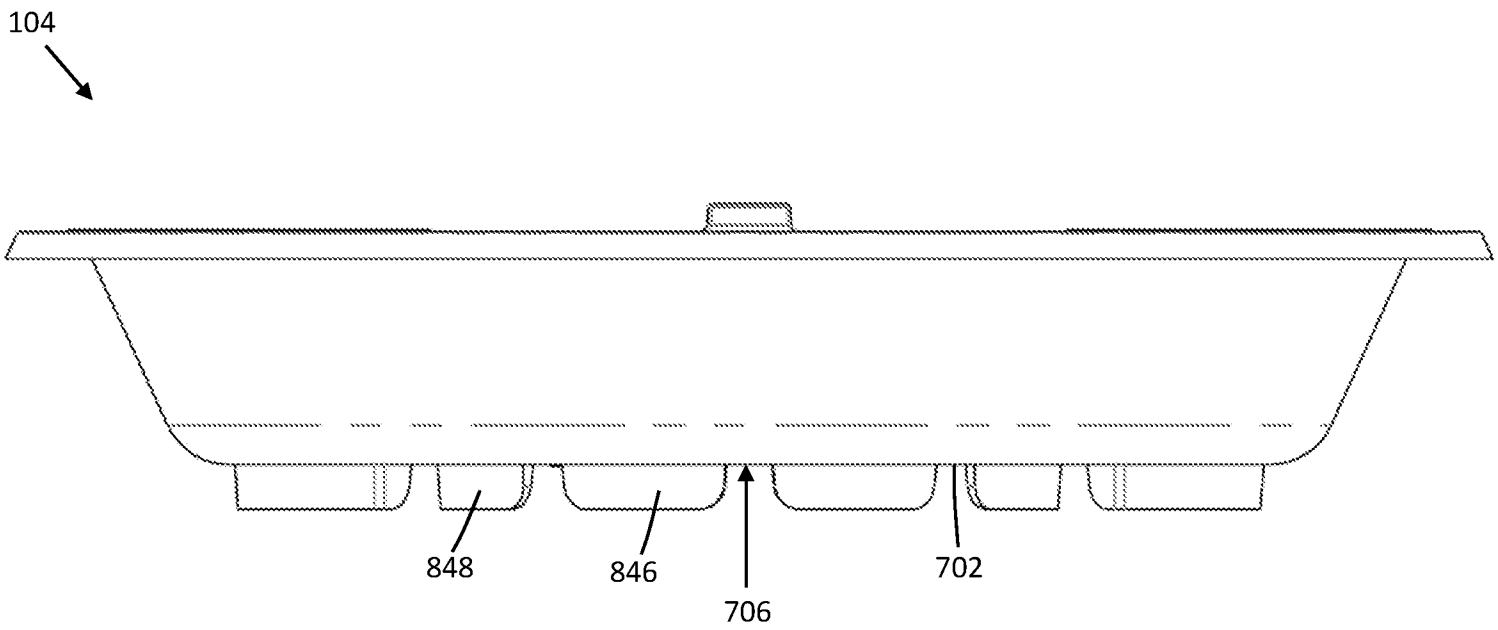
FIG. 13 is an elevational view of the second plate shell in FIG. 1 to be used in accordance with one embodiment of the present invention.

Referring now to FIG. 8, in some embodiments, the bottom surface 706 of the bottom wall 702 of the second plate shell 104 further comprises a first cup support sidewall 846 protruding therefrom, of a circular shape, and defining a circular area shaped and sized to receive an upper end diameter (not shown) of a drinking cup (not shown). The first cup support sidewall 846 protrudes in a substantially perpendicular direction from the bottom surface 706 of the bottom wall 702. In some embodiments, the first cup support sidewall 846 may be continuous (i.e., without gaps), in other embodiments, the first cup support sidewall 846 may be discontinuous (i.e., with gaps). The embodiment of the second plate shell 104 shown in FIGS. 8, 12-13 shows the first cup support sidewall 846 as discontinuous (with gaps). The first cup support sidewall 846 is designed to resist lateral movement (i.e., side-to-side) of the upper end of the drinking cup by holding it in place. Further, the circular area of the first cup support sidewall 846 is within a range of approximately 2.5-3.5 inches to accommodate a majority of conventional cup diameters.

In a further embodiment, the bottom surface 706 of the bottom wall 702 of the second plate shell 104 further comprises a second cup support sidewall 848 protruding therefrom, of a circular shape, and defining a circular area (not shown) shaped and sized to receive an upper end diameter (not shown) of a larger-sized drinking cup (not shown). The second cup support sidewall 848 protrudes in a substantially perpendicular direction from the bottom surface 706 of the bottom wall 702. In some embodiments, the second cup support sidewall 848 may be continuous (i.e., without gaps), in other embodiments, the second cup support sidewall 848 may be discontinuous (i.e., with gaps). The embodiment of the second plate shell 104 shown in FIGS. 8, 12-13 shows the second cup support sidewall 848 as discontinuous (with gaps). Similarly, the second cup support sidewall 848 is designed to resist lateral movement (i.e., side-to-side) of the upper end of the larger-sized drinking cup by holding it in place. Further, the circular area of the second cup support sidewall 848 is within a range of approximately 3.5-4.25 inches to accommodate a majority of larger-sized conventional cup diameters. The first cup support sidewall 846 is concentrically disposed in relation to the second cup support sidewall 848, wherein the circular area of the first cup support sidewall 846 is less than the circular area of the second cup support sidewall 848.

In other embodiments, best shown in FIG. 3A, the bottom surface 206 of the bottom wall 202 of the first plate shell 102 further includes a first plurality of plate support sidewalls 308*a-b*, protruding therefrom in a substantially perpendicular direction. The first plurality of plate support sidewalls 308*a-b* are of a circular shape and define a middle channel 310 therein between. The bottom surface 206 of the bottom wall 202 of the first plate shell 102 further includes a second plurality of plate support sidewalls 312*a-b*, protruding therefrom in a substantially perpendicular direction. The second plurality of plate support sidewalls 312*a-b* opposes the first plurality of plate support sidewalls 308*a-b* in placement on the bottom surface 206 of the bottom wall 202. The second plurality of plate support sidewalls 312*a-b* are of a circular shape and define a middle channel 314 therein between. The bottom surface 206 of the bottom wall 202 of the first plate shell 102 further includes a first plate locking member 316 and a second plate locking member 318 interposed between the first and second plurality of plate support sidewalls 308*a-b*, 312*a-b*. The first and second plate locking members 316, 318 oppose one another in placement on the bottom surface 206 of the bottom wall 202. The first and second plate locking members 316, 318 have a uniform thickness less than the middle channels 310, 314 defined by the first and second plurality of plate support sidewalls 308*a-b*, 312*a-b*.

Similarly, as may be seen in FIG. 8, the bottom surface 706 of the bottom wall 702 of the second plate shell 104 further includes a first plurality of plate support sidewalls 808*a-b*, protruding therefrom in a substantially perpendicular direction. The first plurality of plate support sidewalls 808*a-b* are of a circular shape and define a middle channel 810 therein between. The bottom surface 706 of the bottom wall 702 of the second plate shell 104 further includes a second plurality of plate support sidewalls 812*a-b*, protruding therefrom in a substantially perpendicular direction. The second plurality of plate support sidewalls 812*a-b* opposes the first plurality of plate support sidewalls 808*a-b* in placement on the bottom surface 706 of the bottom wall 702. The second plurality of plate support sidewalls 812*a-b* are of a circular shape and define a middle channel 814 therein between. The bottom surface 706 of the bottom wall 702 of the second plate shell 104 further includes a first plate locking member 816 and a second plate locking member 818 interposed between the first and second plurality of plate support sidewalls 808*a-b*, 812*a-b*. The first and second plate locking members 816, 818 oppose one another in placement on the bottom surface 706 of the bottom wall 702. The first and second plate locking members 816, 818 have a uniform thickness less than the middle channels 810, 814 defined by the first and second plurality of plate support sidewalls 808*a-b*, 812*a-b*.

In other embodiments of the plate attachment assembly 100, the bottom surface 206 of the bottom wall 202 of the first plate shell 102 may not include the first plurality of plate support sidewalls 308*a-b* or the second plurality of plate support sidewalls 312*a-b*. In these embodiments, best shown in FIG. 6, the bottom surface 206 of the bottom wall 202 of the first plate shell 102 includes a first plate support sidewall 602 and a second plate support sidewall 604 which are continuous. Said another way, the first and second plate support sidewalls 602, 604 of the first plate shell 102 do not include the middle channel 310 or the middle channel 314. Further, the bottom surface 206 of the bottom wall 202 of the first plate shell 102 will not include the first plate locking member 316 or the second plate locking member 318. Similarly, in these embodiments of the plate attachment assembly 100, as shown in FIG. 12, the bottom surface 706 of the bottom wall 702 of the second plate shell 104 may not include the first plurality of plate support sidewalls 808*a-b* or the second plurality of plate support sidewalls 812*a-b*. In these embodiments, the bottom surface 706 of the bottom wall 702 of the second plate shell 104 includes a first plate support sidewall 1200 and a second plate support sidewall 1202 which are continuous. Moreover, the first plate support sidewall 1200 does not include the middle channel 810 and the second support sidewall 1202 does not include the middle channel 814. Further, the bottom surface 706 of the bottom wall 702 of the second plate shell 104 will not include the first plate locking member 816 or the second plate locking member 818.

Referring back to FIG. 3A, in other embodiments, the first plurality of plate support sidewalls 308*a-b* has opposing ends 320, 322 with sidewall portions 324, 326 extending inwardly toward a center of the bottom surface 206 of the bottom wall 202 and substantially orthogonal to a portion of the first plurality of plate support sidewalls 308*a-b* in which the sidewall portions 324, 326 extend from. Similarly, the second plurality of plate support sidewalls 312*a-b* has opposing ends 328, 330 with sidewall portions 332, 334 extending inwardly toward a center of the bottom surface 206 of the bottom wall 202 and substantially orthogonal to a portion of the second plurality of plate support sidewalls 312*a-b* in which the sidewall portions 332, 334 extend from.

In a further embodiment, taking plate support sidewall 308*a* as an example, said plate support sidewall 308*a* further includes a channel end 342. Moreover, taking the first plate locking member 316 as an example, said first plate locking member 316 includes a left end 336 and a right end 338 opposing the left end 336. The opposing end 320 of the plate support sidewall 308*a* and the left end 336 of the first plate locking member 316 are separated by a distance 340. Further, the opposing end 320 and the channel end 342 of the plate support sidewall 308*a* are separated by a distance 344. The distance 340 and the distance 344 are equal. The distance between the opposing ends of each of the plate support sidewalls 308*a-b*, 312*a-b* and the left or right ends of the plate locking members 316, 318 may equate to the distance 340. Further, the distance between the opposing ends and the channel ends of each of the plate support sidewalls 308*a-b*, 312*a-b* may equate to the distance 344. It should be understood that terms such as, "front," "rear," "side," top," "bottom," "left," "right," and the like are indicated from the reference point of a viewer viewing the first plate shell 102 from the perspective shown in FIG. 3A.

Referring back to FIG. 8, in a further embodiment, the first plurality of plate support sidewalls 808*a-b* has opposing ends 820, 822 with sidewall portions 824, 826 extending inwardly toward a center of the bottom surface 706 of the bottom wall 702 and substantially orthogonal to a portion of the plurality of plate support sidewalls 808*a-b* in which the sidewall portions 824, 826 extend from. Similarly, the second plurality of plate support sidewalls 812*a-b* has opposing ends 828, 830 with sidewall portions 832, 834 extending inwardly toward a center of the bottom surface 706 of the bottom wall 702 and substantially orthogonal to a portion of the plurality of plate support sidewalls 812*a-b* in which the sidewall portions 832, 834 extend from.

In a further embodiment, taking plate support sidewall 808*a* as an example, said plate support sidewall 808*a* further includes a channel end 836. Moreover, taking the first plate locking member 816 as an example, said first plate locking member 816 includes a left end 838 and a right end 840 opposing the left end 838. The opposing end 820 of the plate support sidewall 808*a* and the right end 840 of the first plate locking member 816 are separated by a distance 842. Further, the opposing end 820 and the channel end 836 of the plate support sidewall 808*a* are separated by a distance 844. The distance 842 and the distance 844 are equal. The distance between the opposing ends of each of the plate support sidewalls 808*a-b*, 812*a-b* and the left or right ends of the plate locking members 816, 818 may equate to the distance 842. Further, the distance between the opposing ends and the channel ends of each of the plate support sidewalls 808*a-b*, 812*a-b* may equate to the distance 844. It should be understood that terms such as, "front," "rear," "side," top," "bottom," "left," "right," and the like are indicated from the reference point of a viewer viewing the second plate shell 104 from the perspective shown in FIG. 8.

In other embodiments, the first plurality of plate support sidewalls 308*a-b* of the first plate shell 102 may not include the sidewall portions 324, 326 and the second plurality of plate support sidewalls 312*a-b* of the first plate shell 102 may not include the sidewall portions 332, 334. Further, in these embodiments, the first plurality of plate support sidewalls 808*a-b* of the second plate shell 104 may not include the sidewall portions 824, 826 and the second plurality of plate support sidewalls 812*a-b* of the second plate shell 104 may not include the sidewall portions 832, 834.

In some embodiments, as depicted in FIG. 2, the flange 214 of the first plate shell 102 further includes a lower surface 236 opposing the upper surface 224. The lower surface 236 and the upper surface 224 of the flange 214 define one or more locking tab receiving aperture(s) 238*a-b* disposed thereon. The locking tab receiving apertures 238*a-b* feature many of the same main components included within the locking tab receiving apertures 720*a-b* depicted in FIGS. 7, 8-8A and described above.

In a further embodiment, referring back to FIG. 7, the second plate shell 104 may further include one or more locking tab(s) 722*a-b* disposed on the flange 714. The locking tab(s) 722*a-b* feature many of the same main components included within the locking tab(s) 216*a-b* depicted in FIGS. 2, 3, 4A and described above.

Referring back to FIGS. 1, 14-14A, in order to interlock the first plate shell 102 onto the second plate shell 104, a user would first align the first and second plate shells 102, 104 such that the interior surfaces 204, 704 (not shown) of the bottom walls 202, 702 are opposing each other and the upper surfaces 224, 716 of the flanges 214, 714 are directly opposing one another. Moreover, a user would align the flanges 214, 714 such that the locking tabs 216*a-b* of the first plate shell 102 are inserted into the locking tab receiving apertures 720*a-b* of second plate shell 104 and the locking tabs 722*a-b* (not shown) of the second plate shell 104 are inserted into the locking tab receiving apertures 238*a-b* of the first plate shell 102. Then, a user would twist the first and second plate shells 102, 104 in opposite longitudinal directions, allowing the locking tabs 722*a-b* of the second plate shell 104 to slide down the ramps (not shown) of the bottom surface 236 of the flange 214 of the of the first plate shell 102. Simultaneously, the locking tabs 216*a-b* of the first plate shell 102 will slide up the ramps 804*a-b* of the bottom surface 718 of the flange 714 of the second plate shell 104. Further, in the preferred embodiment, a user would twist the first plate shell 102 in a counterclockwise rotation while simultaneously twisting the second plate shell 104 in a clockwise rotation. To securely lock the first plate shell 102 onto the second plate shell 104 in the locking configuration, a user would continue to twist the first and second plate shells 102, 104 in opposing directions until, for example, the locking protrusion 406 of the locking tab 216*a* of the first plate shell 102 falls into place on the notch 802*a* of the second plate shell 104. Further, to open the plate attachment assembly 100 and detach the first plate shell 102 from the second plate shell 104, a user would simply have to twist the first and second plate shells 102, 104 in opposing directions and pull the first and second plate shells 102, 104 apart. In the preferred embodiment, to open the assembly 100, a user would twist the first plate shell 102 in a clockwise rotation while simultaneously twisting the second plate shell 104 in a counterclockwise rotation. To overcome the locking configuration in the preferred embodiment, a user would have to apply approximately 1-3 lbf of force to separate the first plate shell 102 from the second plate shell 104, applying such force as to overcome the locking protrusion and notch closure.

Figure 15:
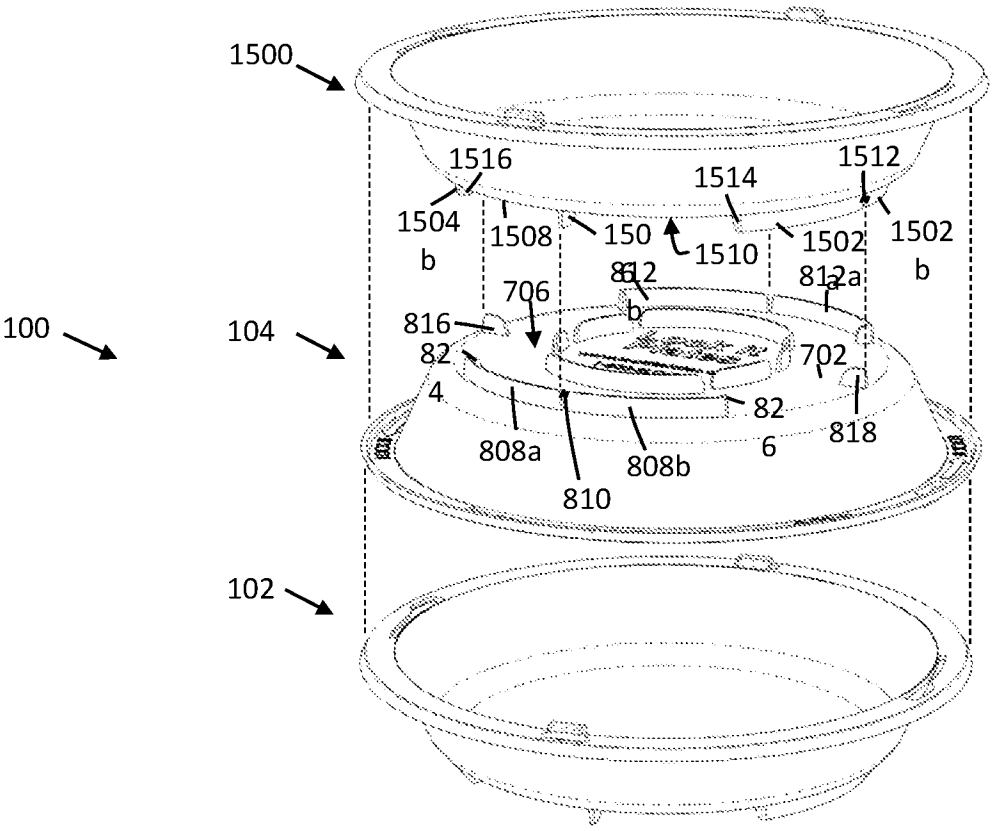
FIG. 15 is a perspective view of a plate attachment assembly according to one embodiment of the present invention.

Best depicted in FIG. 15, the second plate shell 104 of the plate attachment assembly 100 is operably configured to interlock onto a first plate shell 1500 of another plate attachment assembly. The first plate shell 1500 includes all of the same main components that the first plate shell 102 includes as described above. Thus, as a representative sample of the method in which the second plate shell 104 interlocks onto the first plate shell 1500, the first plurality of plate support sidewalls 808*a-b* of the second plate shell 104 as well as the second plate locking member 818 will be described herein. Moreover, the first plate shell 1500 includes a first plurality of plate support sidewalls 1502*a-b* featuring the same main components as the first plurality of plate support sidewalls 308*a-b* of the first plate shell 102 described above and seen in FIG. 3A. The first plate shell 1500 also includes a second plurality of plate support sidewalls 1504*a-b* featuring the same main components as the second plurality of plate support sidewalls 312*a-b* of the first plate shell 102 described above and seen in FIG. 3A. Additionally, the first plate shell 1500 also includes a first plate locking member 1506 and a second plate locking member (not shown) featuring the same main components as the first and second plate locking members 316, 318 of the first plate shell 102 described above and seen in FIG. 3A. The bottom surface 706 of the bottom wall 702 of the second plate shell 104 couples to a bottom surface 1510 of a bottom wall 1508 of the first plate shell 1500. For exemplary purposes, when a user interlocks the second plate shell 104 onto the first plate shell 1500, the first plate locking member 1506 of the first plate shell 1500 is disposed within the middle channel 810 between the first plurality of plate support sidewalls 808*a-b* of the second plate shell 104. Further, the second plate locking member 818 of the second plate shell 104 is disposed within a middle channel 1512 between the first plurality of plate support sidewalls 1502*a-b* of the first plate shell 1500. This same method of placement is duplicated for the second plate locking member (not shown) of the first plate shell 1500 and the first plate locking member 816 of the second plate shell 104.

Figure 16:
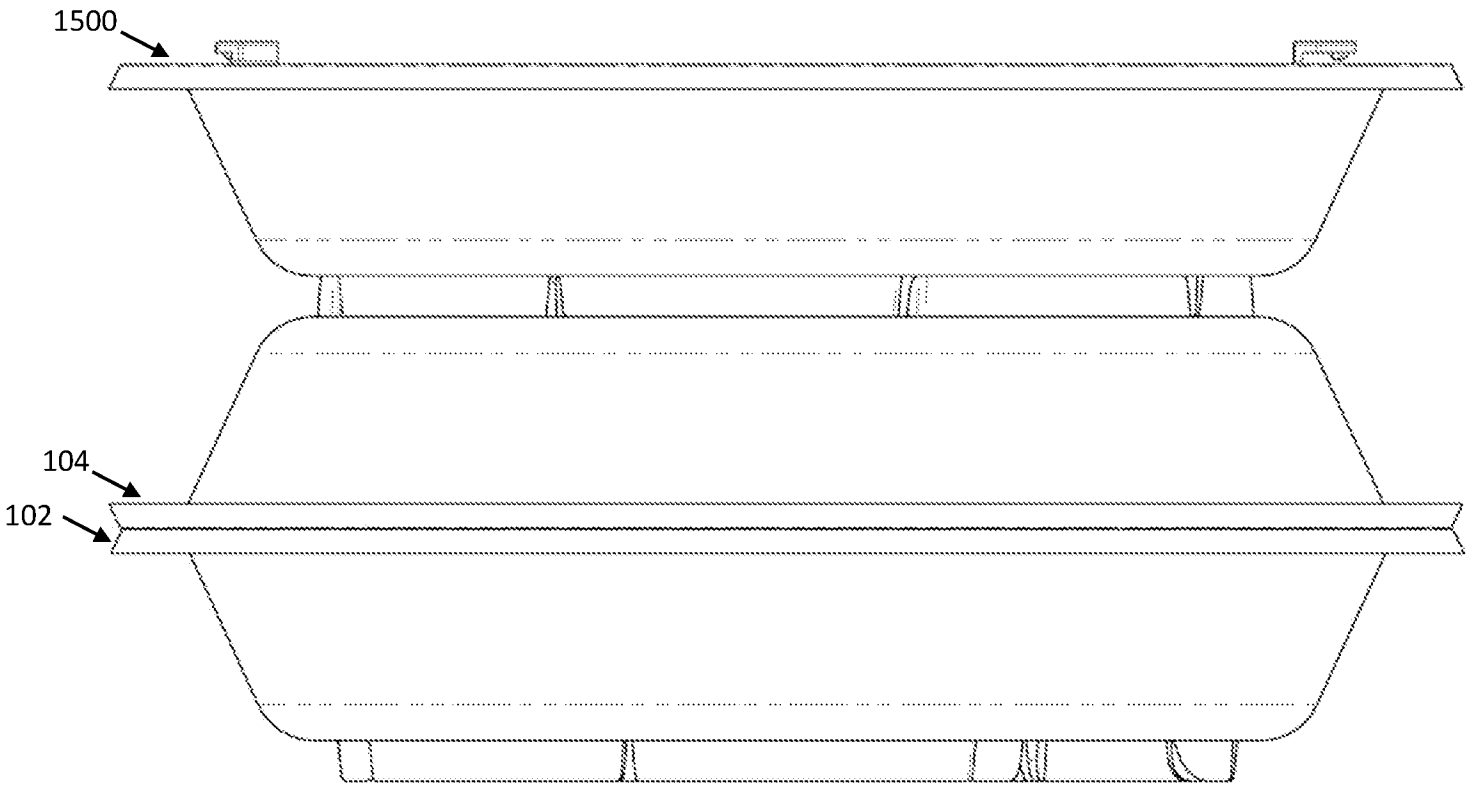
FIG. 16 is a perspective view of a plate attachment assembly with multiple plate shells coupled together in accordance with one embodiment of the present invention.
Figure 17:
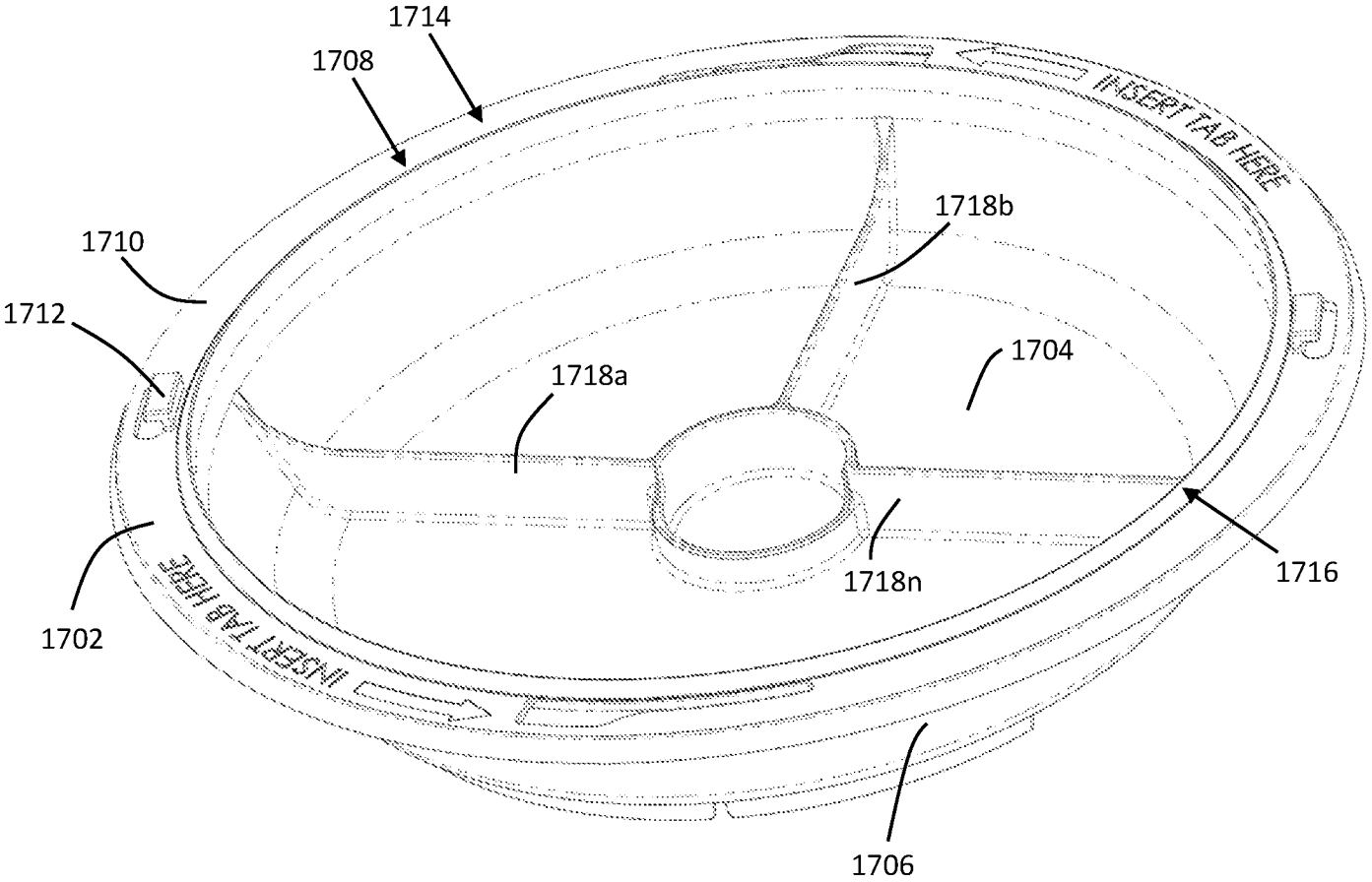
FIG. 17 is a perspective view of a first plate shell of a plate attachment assembly in accordance with one embodiment of the present invention.
Figure 18:
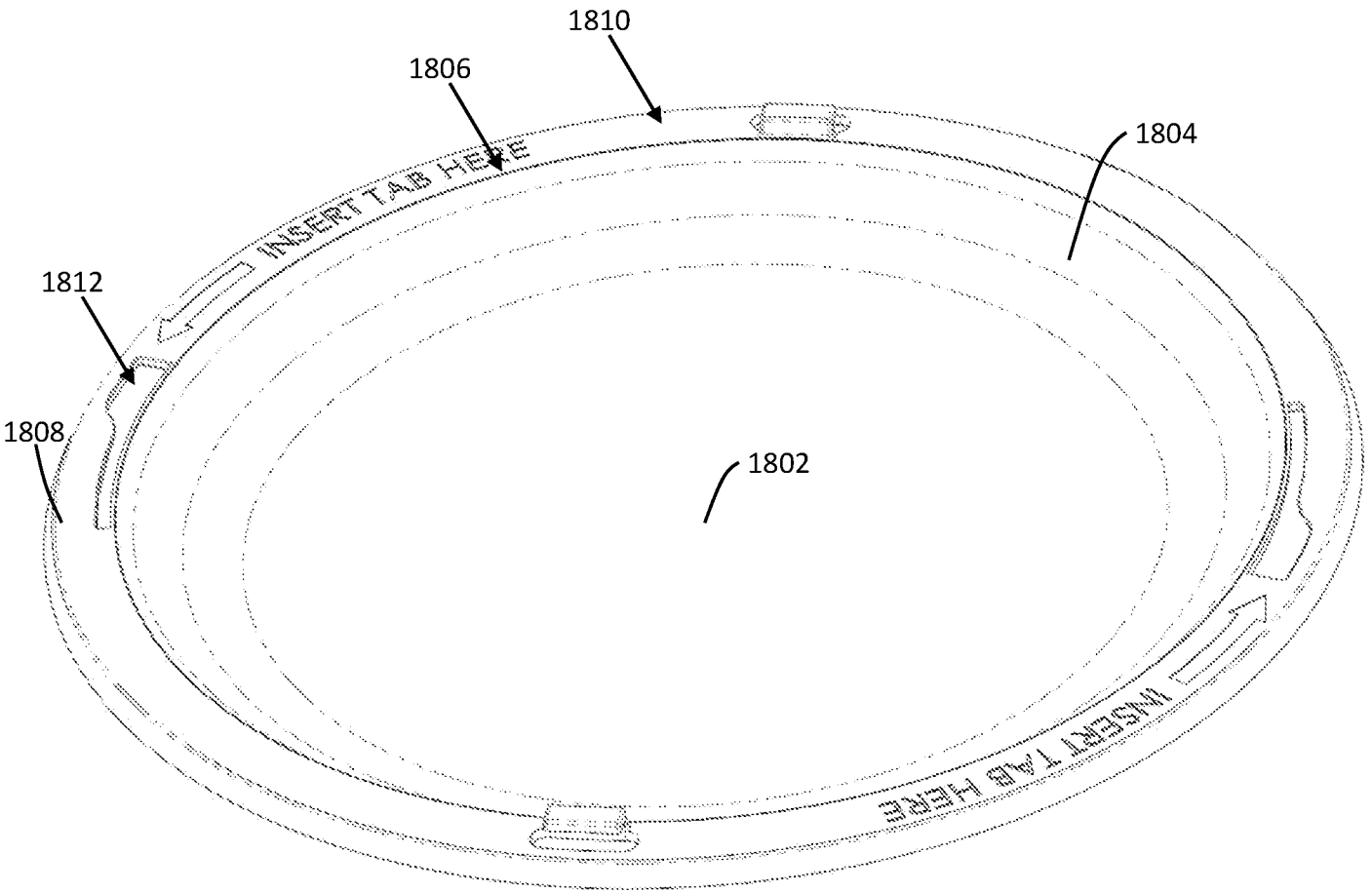
FIG. 18 is a perspective view of a second plate shell of the plate attachment assembly in accordance with one embodiment of the present invention.
Figure 19:
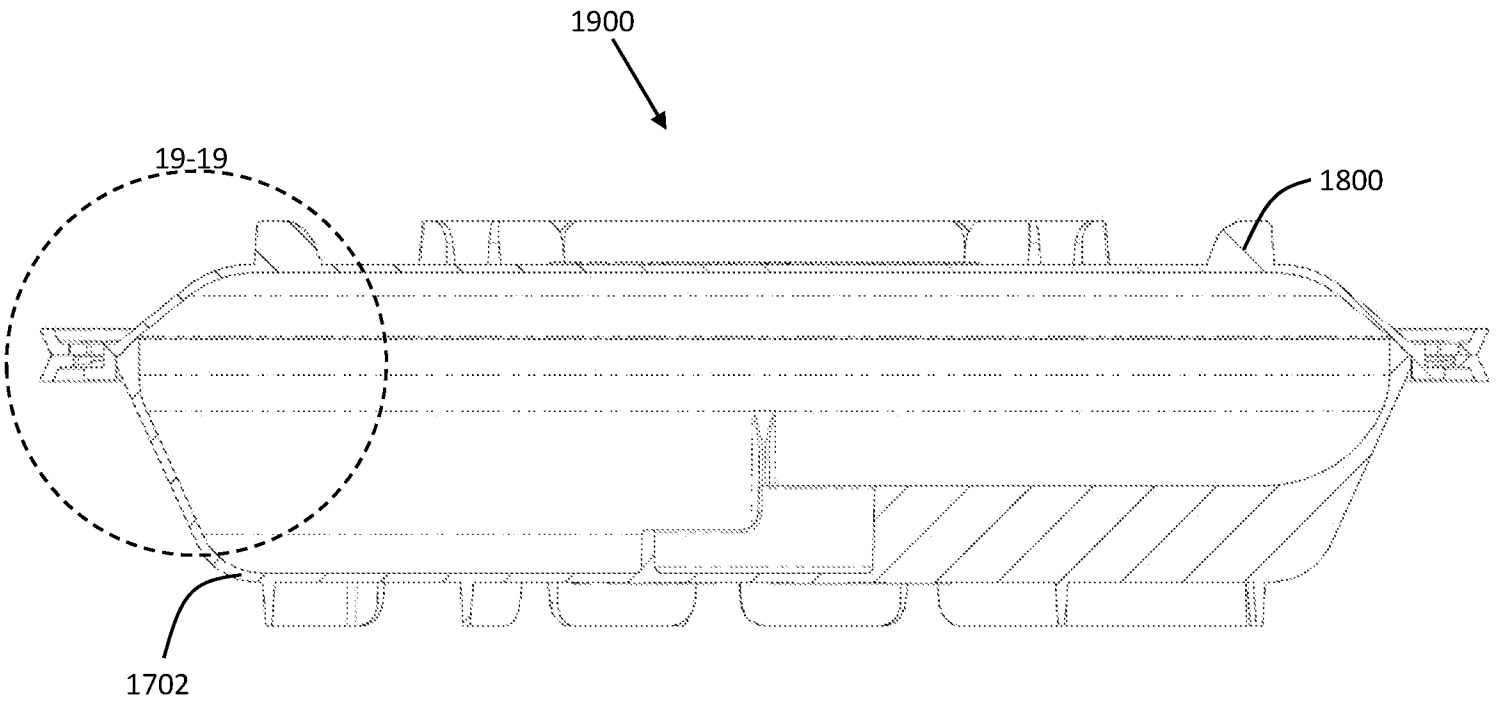
FIG. 19 is an elevational side view of the first and second plate shells of FIGS. 17-18 coupled together.
Figure 20:
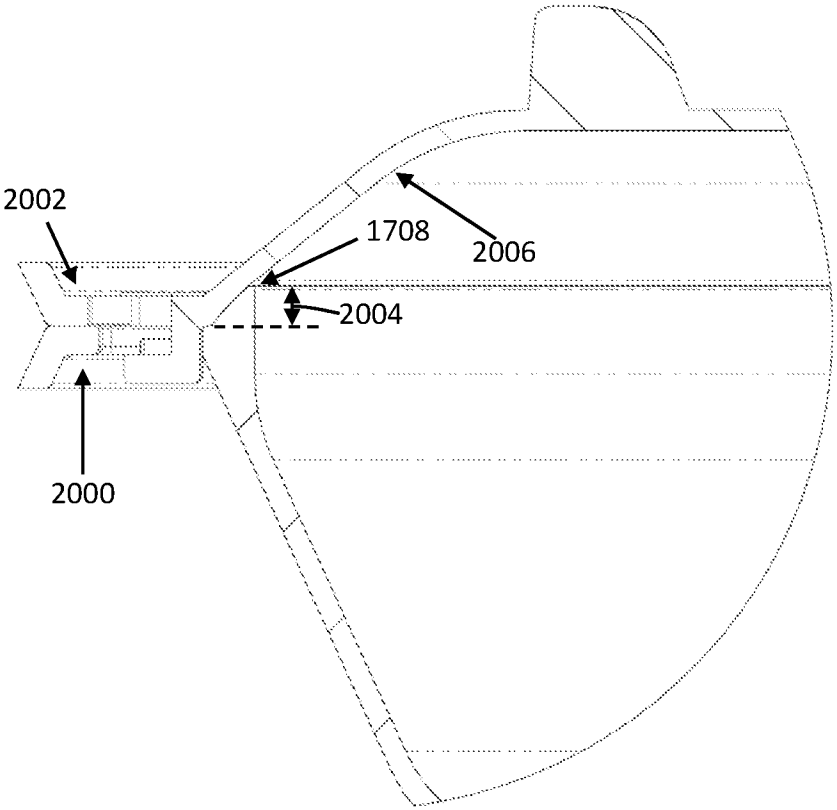
FIG. 20 is a close-up view of section 19-19 depicted in FIG. 19.

With reference to FIG. 16, the plate attachment assembly 100 is shown with multiple plate shells 102, 104, 1500 coupled together. In preferred embodiments, the plate shells 102, 104, 1500 interlock together as described above, thereby preventing lateral and/or rotational movement thereon. As those of skill in the art will appreciate, one beneficial aspect of the present invention is for two or more plate shell assemblies to stack on one another. As such, a user can carry multiple plates on top of one another in a safe and effective manner.

In a further embodiment, the first plate shell 1500 further includes sidewall portions 1514, 1516 which are similar to the sidewall portions 324, 334 described above and seen in FIG. 3A. As a representative sample of the placement of the sidewall portions of each plate shell against one another when two plate assemblies are interlocked, the placement of sidewall portions 824, 826 of second plate shell 104 with respect to the sidewall portions 1514, 1516 of first plate shell 1500 will be described herein. The sidewall portions help stabilize the second plate shell 104 and the first plate shell 1500 when joined together and resist lateral movement of both the second and first plate shells 104, 1500. Said another way, the sidewall portions 824, 826, 1514, 1516 prevent rotation or twisting of the second and first plate shells 104, 1500 when joined together. The sidewall portion 824 of the second plate shell 104 lays against the sidewall portion 1516 of the first plate shell 1500 while the sidewall portion 826 of the second plate shell 104 lays against the sidewall portion 1514 of the first plate shell 1500. Therefore, the second and first plate shells 104, 1500 lay against one another correctly and evenly providing secure support to the plate attachment assemblies.

With reference to FIGS. 17-20, another embodiment of the present invention is depicted. More specifically, another version of a plate attachment assembly 1900 (depicted best in FIG. 19) is depicted that includes a first plate shell 1702 and a second plate shell 1800 directly coupled together in a watertight configuration using a raised sidewall thereon. The locking or coupling of the first and second plate shells 1702, 1800 have many, if not the same, features described above.

However, the first plate shell 1702 has a bottom wall 1704, a sidewall 1706 surrounding the bottom wall 1704 and has an upper terminal end 1708 defining a continuous upper perimeter. If the plates are circular, the perimeter may be circular. The first plate shell 1702 also includes a flange 1710 disposed around the sidewall 1706 of the first plate shell 1702. In one embodiment, the flange 1710 may be disposed or extend radially from the sidewall as shown in the figures (in some embodiments extending radially at a substantially perpendicular angle). The flange 1710 has a lower surface 2000 and an upper surface 1714 opposing the lower surface 200 of the flange 1710. Beneficially, however, the continuous upper perimeter of the upper terminal end 1708 disposed in a raised configuration above the flange 1710, thereby enabling a watertight seal and configuration as discussed herein.

The second plate shell 1800 has a bottom wall 1802 and a sidewall 1804 (which may or may not extend perpendicular or at an angle to the bottom wall 1802—as the other sidewalls referenced herein) surrounding the bottom wall 1802. The sidewall 1804 has an upper end 1806 and also includes a flange 1808 disposed around the sidewall 1804 of the second plate shell 1800, wherein the flange also includes a lower surface 2002 and an upper surface 1810 opposing the lower surface 2002 of the flange 1808 of the second plate shell 1800.

The assembly 1900 also includes a locking tab 1712 disposed one or both of the flange(s) of the first plate shell 1702 and the second plate shell 1800 and includes a lateral locking portion disposed thereon. The assembly 1900 also includes a locking tab receiving aperture 1812 disposed on another of the flange(s) of first plate shell 1702 and the second plate shell 1800. Said another way, at least one of the shells 1702, 1800 includes a locking tab and a locking tab aperture. The locking tab aperture is shaped and sized to receive the lateral locking portion of the locking tab 1712. As such, the first plate shell and second plate shell are operably configured to selectively removably couple together in a locking configuration with flanges on each directly coupled together, in a watertight configuration around the continuous upper perimeter, and with the upper terminal end 1708 of the first plate shell 1702 directly coupled to the sidewall 1804 of the second plate shell 1800. This can be best seen in the close-up view in FIG. 20.

In one embodiment, the locking configuration also includes the upper surface of the flange of the first plate shell and lower surface of the flange of the second plate shell in a flush and sealed configuration around the entire periphery of the flanges of the first and second plate shells, thereby preventing liquid from escaping from inside the assembly 1900 when the shells 1702, 1800 are coupled together. The locking configuration may also include the upper surface of the flange of the first plate shell and lower surface of the flange of the second plate shell in a flush and sealed configuration around the entire periphery of the flanges of the first and second plate shells 1702, 1800. Further, the continuous upper perimeter of the upper terminal end 1708 of the first plate shell is disposed in a uniformly spaced raised configuration above the flange. The spatial difference can be best seen in FIG. 20 as arrow 2004 and may be approximately 0.05-0.2 inches in length.

Looking at FIGS. 17-20, an outer surface 1716 separating the flange 1710 and the upper terminal end 1708 of the first plate shell 1702 is disposed at an angled configuration with respect to flange 1710 of the first plate shell 1702, and, when in the locking configuration, directly coupled and flush against an inner surface 2006 of the sidewall 1804 of the second plate shell 1800. In one embodiment, the outer surface 1716 may include a polymeric or other elastically deformable material, e.g., natural rubber, disposed continuously or discontinuously around the perimeter thereon. The outer surface 1716 may also directly couple with and be flush against an inner surface 2006 around the inner periphery thereon.

In another beneficial embodiment, the first plate shell may include a plurality of wall dividers 1718*a-n* extending upwardly from the bottom wall 1704 thereon and toward the upper terminal end 1708 of the first plate shell 1702. The height of the dividers 1718*a-n* may be approximately ½ inch and for the lower part of the circle (shown best in FIG. 17), it will be ¼ inch. The measurement of the circle in the middle of the divider is shown and may be 1½ inch. The thickness of the second plate shell may approximately ½ inch.

A plate attachment assembly has been disclosed that includes a first plate shell and a second plate shell that selectively removably couple to one another. The first and second plate shells include one or more locking tabs and one or more locking tab receiving apertures. The locking tabs and locking tab receiving apertures couple to one another to dispose the first and second plate shells in a locking configuration. The first and second plate shells further include a cup support sidewalls and a plurality of plate support sidewalls which allow the plate attachment assembly to be securely coupled to a drinking cup and/or another plate attachment assembly, respectively.

What is claimed is:

1. A plate attachment assembly comprising:

a first plate shell having a bottom wall, a sidewall surrounding the bottom wall and having an upper terminal end defining a continuous upper perimeter, a flange disposed around the sidewall of the first plate shell, having a lower surface, and having an upper surface opposing the lower surface of the flange, and having an angled surface separating the upper surface of the flange and the upper terminal end of the first plate shell, disposed at an angled configuration with respect to the upper surface of the flange of the first plate shell, the continuous upper perimeter of the upper terminal end disposed in a raised configuration above the flange;

a second plate shell having a bottom wall, a sidewall surrounding the bottom wall, having an inner surface, and having an upper end, and with a flange disposed around the sidewall of the second plate shell, having a lower surface, and having an upper surface opposing the lower surface of the flange of the second plate shell;

a locking tab disposed on at least one of the flange of the first plate shell and the second plate shell and having a lateral locking portion; and a locking tab receiving aperture disposed on another of the at least one of the flange of the first plate shell and the second plate shell and shaped and sized to receive the lateral locking portion of the locking tab, the first plate shell and second plate shell are operably configured to selectively removably couple together in a locking configuration with flanges on each directly coupled together, in a watertight configuration around the continuous upper perimeter, and with the upper terminal end of the first plate shell directly coupled to the sidewall of the second plate shell, the locking configuration with the angled surface directly coupled to and flush against a portion of the inner surface of the sidewall of the second plate shell in a watertight configuration and a parallel and angled orientation around the inner periphery thereon in a watertight configuration, the inner surface of the sidewall of the second plate shell spanning downwardly continuously from the bottom wall of the second plate shell until reaching the upper surface of the flange of the first plate shell.

2. The plate attachment assembly according to claim 1, wherein the locking tab further comprises:

an upright locking portion with an upper end and an inner surface, the lateral locking portion coupled to and extending away from the upper end of the upright locking portion and with an inner surface, the inner surfaces of the upright and lateral locking portions of the locking tab defining a secondary flange receiving channel; and a locking protrusion coupled to and extending downwardly from the inner surface of the lateral locking portion of the locking tab and with a distal free end terminating in the secondary flange receiving channel.

3. The plate attachment assembly according to claim 2, wherein:

the distal free end of the locking protrusion is rounded.

4. The plate attachment assembly according to claim 3, wherein:

the lower surface of the flange defining the locking tab receiving aperture defining a notch thereon and of a shape corresponding to the rounded distal free end of the locking protrusion.

5. The plate attachment assembly according to claim 4, wherein the locking configuration further comprises:

the upper surface of the flange of the first plate shell and lower surface of the flange of the second plate shell in a flush and sealed configuration around the entire periphery of the flanges of the first and second plate shells.

6. The plate attachment assembly according to claim 1, wherein the locking configuration further comprises:

the upper surface of the flange of the first plate shell and lower surface of the flange of the second plate shell in a flush and sealed configuration around the entire periphery of the flanges of the first and second plate shells.

7. The plate attachment assembly according to claim 1, wherein:

the continuous upper perimeter of the upper terminal end of the first plate shell is disposed in a uniformly spaced raised configuration above the flange.

8. The plate attachment assembly according to claim 1, wherein the first plate shell further comprises:

a plurality of wall dividers extending upwardly from the bottom wall thereon and toward the upper terminal end of the first plate shell.

* * * * *